US010232202B1

(12) United States Patent
Stimek

(10) Patent No.: US 10,232,202 B1
(45) Date of Patent: Mar. 19, 2019

(54) SELF CONTAINED STOVETOP FIRE SUPPRESSOR WITH ALERT SIGNAL AND METHOD

(71) Applicant: Christopher M Stimek, Fort Worth, TX (US)

(72) Inventor: Christopher M Stimek, Fort Worth, TX (US)

(73) Assignee: WilliamsRDM, Inc, Fort Worth, TX (US)

( * ) Notice: Subject to any disclaimer, the term of this patent is extended or adjusted under 35 U.S.C. 154(b) by 0 days.

(21) Appl. No.: 15/259,028

(22) Filed: Sep. 7, 2016

(51) Int. Cl.
*A62C 3/00* (2006.01)
*A62C 35/10* (2006.01)
*G08B 17/02* (2006.01)

(52) U.S. Cl.
CPC ..... *A62C 3/006* (2013.01); *A62C 35/10* (2013.01); *G08B 17/02* (2013.01)

(58) Field of Classification Search
CPC ..... A62C 3/006; A62C 13/22; A62C 35/08; A62C 37/11
USPC ..... 169/28, 46; 102/363, 367, 205
See application file for complete search history.

(56) References Cited

U.S. PATENT DOCUMENTS 1,366,873 A * 1/1921 Carpenter ..... A62C 35/605 169/29
1,453,091 A * 4/1923 Delbare ..... A62C 35/605 169/28
1,489,703 A * 4/1924 De Orveille ..... A62C 35/605 169/28
2,091,589 A * 8/1937 Finzi ..... F42C 15/36 102/401
2,328,491 A * 8/1943 Puchner ..... F42B 27/08 169/28
2,357,682 A * 9/1944 Morton ..... G08B 17/02 169/26
2,383,048 A * 8/1945 Eckert, Jr. ..... A62C 13/22 169/28
2,417,374 A * 3/1947 Morton ..... A62C 35/605 169/26
2,719,589 A * 10/1955 Mapes ..... A62C 13/22 169/28
3,653,443 A * 4/1972 Dockery ..... A62C 3/006 169/19
3,833,063 A * 9/1974 Williams ..... A62C 13/006 169/28

(Continued)

*Primary Examiner* — Viet Le
(74) *Attorney, Agent, or Firm* — Morani Patent Law, PC

(57) ABSTRACT

An automatic stovetop fire suppressor with suppressor activation triggering an audible alert of a fire condition and method are provided herein. A plastic bottom lid is secured to a bottom of a can, forming a closed container. A fire suppressing agent and a sound board are housed within the closed container. As the fire suppressor actuator is triggered, the bottom lid lowers releasing the fire suppressing agent and tripping a sound board alert switch. A microcontroller generates a desired fire condition signal which is played across a low voltage magnetic transducer. The suppressor is user friendly, provides an automated release of fire suppressing agent in the presence of a stovetop fire, and emits a continuing audible alert signal until a user disables the same. The fire suppressing agent and battery powered sound board are stored in the closed from manufactured end to activation of the suppressor in a fire condition.

5 Claims, 17 Drawing Sheets

(56) References Cited

U.S. PATENT DOCUMENTS 3,874,458 A * 4/1975 Williams ..... A62C 99/0027 169/28
3,884,306 A * 5/1975 Williams ..... A62C 3/006 169/28
3,884,307 A * 5/1975 Williams ..... A62C 35/10 169/28
3,897,828 A * 8/1975 Glover ..... A62C 37/12 169/26
4,011,911 A * 3/1977 Gow ..... A62C 35/04 169/29
4,356,478 A * 10/1982 Muggli ..... G08B 17/06 337/140
4,691,783 A * 9/1987 Stern ..... G08B 17/00 169/19
4,813,487 A * 3/1989 Mikulec ..... A62C 3/006 169/26
4,964,469 A * 10/1990 Smith ..... A62C 3/025 102/488
5,094,298 A * 3/1992 Polan ..... A62C 37/09 169/19
5,297,636 A * 3/1994 North ..... A62C 3/006 169/65
5,315,292 A * 5/1994 Prior ..... A62C 37/38 169/61
5,375,523 A * 12/1994 Morris ..... F42B 4/00 102/202.9
5,518,075 A * 5/1996 Williams ..... A62C 35/08 169/28
5,808,541 A * 9/1998 Golden ..... A62C 37/40 169/26
5,868,205 A * 2/1999 Cunningham ..... A62C 3/006 169/26
5,950,982 A * 9/1999 Williams ..... F16K 35/10 251/285
6,104,817 A * 8/2000 Ding ..... H04R 3/00 381/96
6,105,677 A * 8/2000 Stager ..... A62C 37/12 169/26
6,527,535 B1 * 3/2003 Han ..... B30B 15/022 264/3.1
7,147,061 B2 * 12/2006 Tsutaoka ..... A62C 8/005 169/28
7,385,480 B2 * 6/2008 Fitzpatrick ..... A62C 99/0045 169/58
7,472,758 B1 * 1/2009 Stevens ..... A62C 35/08 102/322
7,610,966 B1 * 11/2009 Weintraub ..... A62C 3/006 169/26
7,850,208 B2 * 12/2010 Greenberger ..... F16L 19/08 285/243
7,934,564 B1 * 5/2011 Stell ..... A62C 37/36 169/26
8,517,117 B2 * 8/2013 Mikulec ..... F24C 15/2021 169/33
8,622,147 B1 * 1/2014 Williams ..... G08B 17/10 169/26
9,044,627 B1 * 6/2015 Williams ..... A62C 3/006
9,339,672 B2 * 5/2016 Williams ..... A62C 35/08
9,517,370 B2 * 12/2016 Murray ..... A62C 35/08
9,636,530 B2 * 5/2017 Murray ..... A62C 37/14
2008/0087446 A1 * 4/2008 Sitabkhan ..... A62C 37/12 169/57
2013/0175058 A1 * 7/2013 Williams ..... A62C 35/08 169/46
2015/0238790 A1 * 8/2015 Murray ..... A62C 37/14 169/46

* cited by examiner

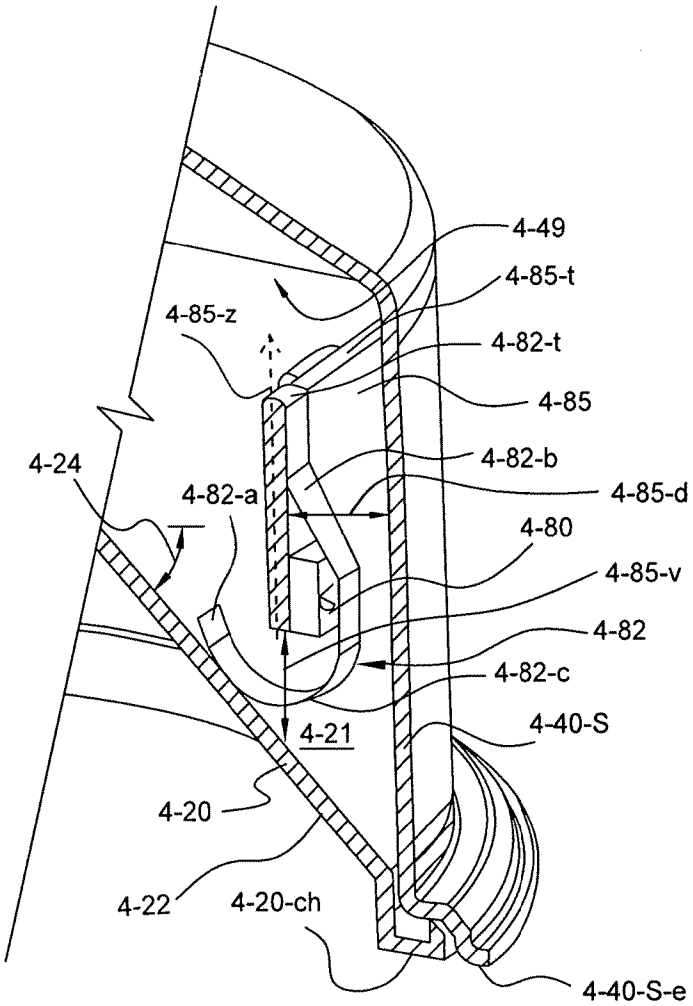
FIG. 4C
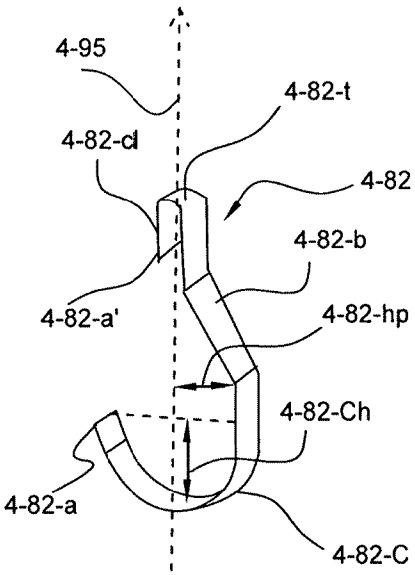
FIG. 4F
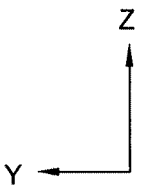

SELF CONTAINED STOVETOP FIRE SUPPRESSOR WITH ALERT SIGNAL AND METHOD

FIELD OF THE INVENTION

The present invention relates to a device and method of fire suppression, and more particularly to an automatic self-contained stovetop fire suppressor which emits an audio alert signal upon activation.

BACKGROUND OF THE INVENTION

Stovetop fires are a well-known residential and commercial hazard. An unattended stovetop fire, for example a grease fire, can lead to structural damage or injury. Even if a stovetop fire is attended, an automatic extinguishing method may be more effective and expedient compared to manual means. Conventional fire extinguishers can provide efficient and automatic stovetop fire suppression and include, for example, the automatic stovetop fire extinguisher taught by Williams, U.S. Pat. No. 5,518,075. In addition, a conventional stovetop fire suppressor, such as a STOVETOP FIRESTOP® fire suppressor (WilliamsRDM, Inc., Fort Worth, Tex, USA) may also provide a one shot high decibel activation alarm. FIG. 1A shows a conventional stovetop fire suppressor with a one shot high decibel signal upon activation.

Conventional fire suppressors which are particularly well suited to a stovetop environment include a container of an extinguishing agent and are mounted to a vent hood above the stovetop. An example of such an extinguisher is shown in FIG. 1A. Turning to FIG. 1A, a cross sectional view along the center axis of a closed container automatic stovetop fire suppressor is shown. Through the bottom wall or lid 20 of the container 40 extends a fuse 10. A fire on the stovetop ignites the fuse 10, which in turn triggers an initiator 30. An initiator housing 34 is affixed to the bottom lid 20. The fuse 10 extends into the initiator housing 34, wherein an explosive charge is housed, charge not shown. The initiator 30 opens the bottom 20 of the container 40, thereby allowing the disbursement of the extinguishing agent 49 onto the fire and the stovetop. The container is secured via a magnet 50 to a hood over the stove. Turning to FIG. 1B, Referring to FIG. 1B, the bottom lid 20 has grooves or scored lines 41A-46A selectively formed on the outside thereof to facilitate breaking or rupturing of the bottom end into separate tear-open segments 41-46 without fragmentation to form openings 41B-46B, openings not shown, only in the bottom wall, lid 20, when the free ends of the segments are forced outward to allow the fire extinguishing powder 49, shown in FIG. 1A, to fall or pass outward from the container onto the fire. The fuse 10, shown for example in FIG. 1A, is lit by a stovetop fire which burns into the initiator 30 and ignites a charge. When this occurs, the force of the explosion ruptures the scored or weakened lines and forces the tear open segments 41-46 outward to form the openings 41B-46B and further, a high decibel blast is generated signaling fire suppressor deployment. The fire extinguishing powder then falls out of container 40, shown in FIG. 1A, for example, to extinguish any fire below which may be in a frying pan, for example. While this charge based high decibel blast can be detected for further remedial measures, as shown for example in U.S. Pat. No. 8,622,147 to Williams, it is not created in compression spring opened fire suppressors, shown for example in FIGS. 2A-2B.

A spring loaded fire suppressor can be readily mounted over a stovetop and upon detection of flames, the extinguisher releases a fire suppressant. While release of fire suppressant may extinguish a current fire, a smoke alarm, as a consequence, may not be triggered to alert occupants of the present deployment of fire suppressant and any potential for subsequent additional fires. To avoid an unwarranted smoke alarm trigger, the conventional smoke alarm in a typical residence is not placed near the cooking area. This typical proximity may decrease the likelihood of the smoke detector triggering upon activation of a distant automatic stovetop fire extinguisher.

A number of conventional automatic stovetop fire extinguishers, which mount above the stovetop surface, are available. These include: U.S. Pat. No. 6,105,677 to Stager using pressurized liquid; U.S. Pat. No. 6,276,461 to Stager using a pendulum device; U.S. Pat. No. 5,899,278 to Mikulec using fluid under pressure; U.S. Pat. No. 7,472,758 to Stevens and Weintraub using a fuse activated initiator; U.S. Pat. No. 5,518,075 to Williams using a self-contained device with fire suppressing powder-like agent; U.S. Pat. No. 4,256,181 to Searcy using pyrotechnic fuse; and U.S. Pat. No. 5,297,636 to North using fluid under pressure. While different fire suppression devices can be deployed to release flame suppressing matter, attendance to the stovetop is not automated or guaranteed. Perhaps one resident has fallen asleep and a second has entered the area unawares. A smoke alarm may not be timely triggered, or triggered at all, in view of the released fire suppressing matter. It would be desirable to quench a stovetop flame and automatically transmit an ongoing audible alarm until a user tends to the stovetop.

It would be desirable to provide an automatic fire extinguisher and fire alarm system which suppressed any present flames while alerting building occupants of the hazardous situation. Depending on the applicable fire code, the building environment, and building residents themselves, a fire system may be required to have both extinguishment and alert functions. As, an example, it may desirable or required by fire codes to alert the neighboring apartments or dorm rooms of a fire hazard condition in an adjacent dwelling. For a multitude of situations, it would be desirable to provide an efficient, economical, easy to use and automatic stovetop fire suppresser and fire alert system.

SUMMARY OF THE INVENTION

The present invention addresses some of the issues presented above by providing an ongoing activation alarm signal and controlled release of a fire suppressing agent via a self-contained automatic stovetop fire suppressor. Embodiments of the present invention may have any of the aspects below. Aspects of the present invention are provided for summary purposes and are not intended to be all inclusive or exclusive. Embodiments of the present invention may have any of the aspects below.

By implementing an activation process which incorporates the release of compressed spring energy to deploy, to lower, a bottom lid, the present invention can employ an alert signal upon fire suppressor activation in accordance with embodiments of the present invention. The signal generator and transmitter provide a multitude of desirable qualities to the automatic stovetop fire suppressor device and method. As applied in embodiments of the present fire suppressor invention, these qualities include alerting those in adjacent and nearby areas of the deployment of an automatic fire suppressor and possible fire condition.

One aspect of the present invention is to provide a user friendly method of suppressing a stovetop fire.

Another aspect of the present invention is to provide an automated release of fire suppressing agent in the presence of a stovetop fire.

Another aspect of the present invention is a mounting device and method, or compatibility with the same, which affords full and proper function of a stovetop fire suppressor mounted beneath a vent hood.

Another aspect of the present invention is to be compatible with a convenient mounting device for a micro-hood stovetop environment.

Yet another aspect of the present invention is to provide a consistent release of fire suppressing agent upon activation of the stove top fire suppressor. Another aspect of the present invention is to provide a gradual release of fire suppressing agent over time. Another aspect of the present invention is to provide a desired distribution pattern of fire suppressing agent in a fire condition.

Another aspect of the present invention is to provide a closed fire extinguishing container in an inactivated state.

Another aspect of the present invention is the ability to use off the shelf parts in the stovetop fire suppressing device.

Yet another aspect of the present invention is to provide stovetop fire suppressor using a combination of ready-made and custom made parts.

Another aspect of the present invention is a relative ease of use in employment of the present invention in field applications.

Still another aspect of the present invention is the release of compressed spring energy to activate the stovetop fire suppressor. Another aspect of the present invention is a method of lowering a bottom lid to release the fire suppressing agent from the closed container.

Still another aspect of the present invention is the use of plastic for the bottom lid of the fire suppressor container.

Another aspect of the present invention is the containment of the fire suppressing agent in a closed container from manufactured end to activation of the device in a fire condition.

Another aspect of the present invention is open air exposure of a thermal sensitive fuse above the stovetop cooking surface. Another aspect of the present invention is the positioning of the thermal sensitive fuse on an outer side of and beneath a bottom plastic lid.

Still another aspect of the present invention is the use of thermo-molding to create a custom container and a bottom lid.

Still another aspect of the present invention is the use of a plastic custom made cone shaped bottom lid with a magnetic switch gap.

Still another aspect of the present invention is the use of a cone shaped bottom lid retaining a spring sound trigger when closed to the fire suppressor container.

Still another aspect of the present invention is the use of a normally closed push button switch for a sound trigger.

Still another aspect of the present invention is the use of a limit switch on a cone shaped bottom lid as a sound trigger.

Another aspect of the present invention is to trigger a fire condition alert signal upon deployment of the fire suppressor.

Another aspect of the present invention is to provide a continuous audible alarm upon activation of a STOVETOP FIRESTOP® cone lid fire suppressor (WilliamsRDM, Inc., Fort Worth, Tex, USA).

Another aspect of the present invention is to interface with a self-contained fire suppressor to provide a continuing audible alarm to occupants upon the deployment of a local automatic fire suppressor.

Another aspect of the present invention is to provide a continuing audio signal warning those present or those entering a building of a possible fire hazardous condition.

Another aspect of the present invention is to provide an affordable sound based fire alarm, which provides a continuous audible alarm signal to alert residents of a stovetop fire condition and which operates via a self-contained power supply.

Another aspect of the present invention is the use of one or more 3 volt coin cell batteries as the power supply.

Another aspect of the present invention is the use of a microcontroller.

Another aspect of the present invention is the use of an off the shelf magnetic transducer.

Another aspect of the present invention is the use of an amplifier on the acoustic transducer drive current coming out of a microcontroller.

Another aspect of the present invention is lack of symmetry within a given signal period.

Embodiments of the present invention may employ any or all of the exemplary aspects above. Those skilled in the art will further appreciate the above-noted features and advantages of the invention together with other important aspects thereof upon reading the detailed description that follows in conjunction with the drawings.

BRIEF DESCRIPTION OF THE FIGURES

For more complete understanding of the features and advantages of the present invention, reference is now made to the detailed description of the invention along with the accompanying figures, wherein:

FIG. 4C shows a sound board housed in a fire suppressor container of FIG. 4B in more detail, in accordance with an exemplary embodiment of the present invention;

FIG. 4F shows a side perspective view of a flat spring, in accordance with an exemplary embodiment of the present invention;

FIG. 9 shows an exemplary method of automatically sounding a fire alert in a deployed self-contained stovetop fire suppressor, in accordance with

DETAILED DESCRIPTION OF THE INVENTION

The invention, as defined by the claims, may be better understood by reference to the following detailed description. The description is meant to be read with reference to the figures contained herein. This detailed description relates to examples of the claimed subject matter for illustrative purposes, and is in no way meant to limit the scope of the invention. The specific aspects and embodiments discussed herein are illustrative of ways to make and use the invention, and are not intended to limit the scope of the invention. Same reference numbers across views refer to like elements for ease of reference. Reference numbers may also be unique to a respective figure or embodiment.

Figure 1A:
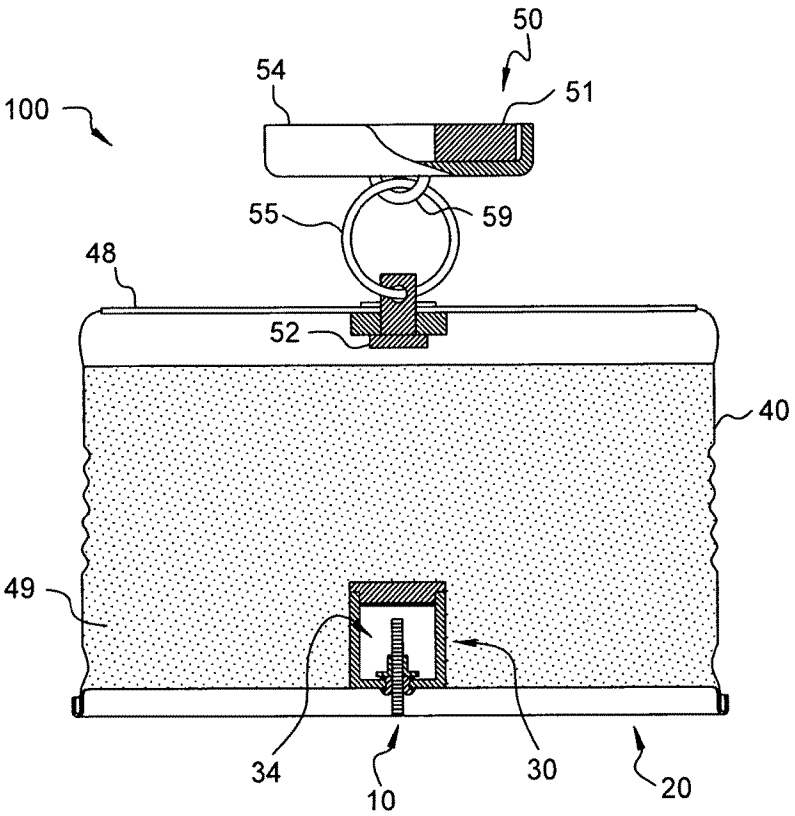
FIG. 1A Prior Art
FIG. 1A shows a partial cross section of a conventional stovetop fire suppressor for mounting under a vent-hood taken through the axial center.
Figure 1B:
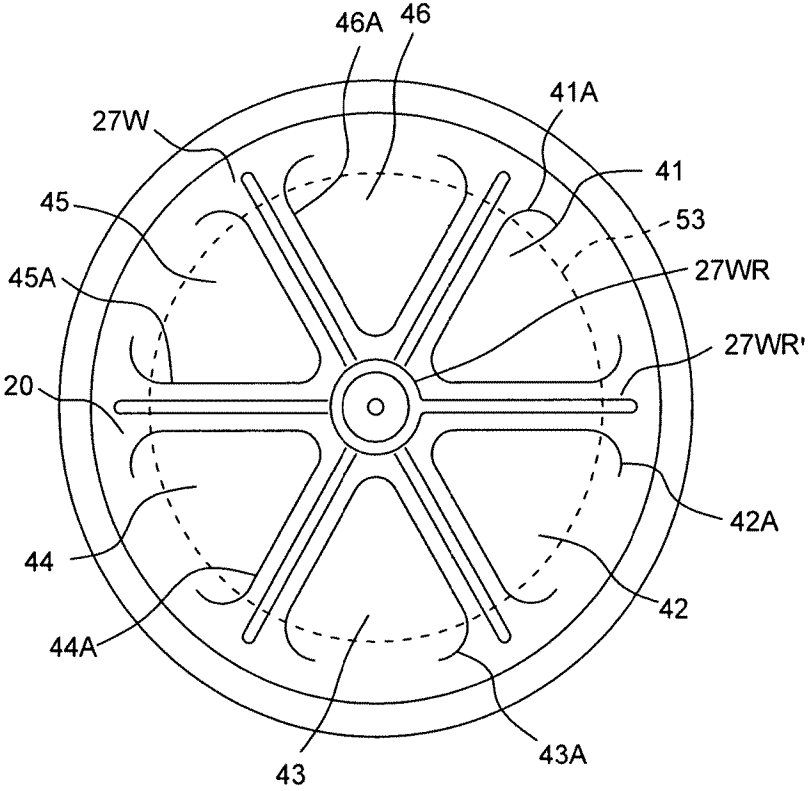
FIG. 1B Prior Art
FIG. 1B shows a bottom view of an outside of a container lid, in accordance with a conventional stovetop fire suppressor.

Conventional fire suppressors, STOVETOP FIRESTOP® fire suppressor (WilliamsRDM Inc., Fort Worth, Tex, USA), which are particularly well suited to a stovetop environment, include a container of an extinguishing agent mounted to a vent hood above the stovetop and activated by a fuse. An example of such a suppressor is shown in FIGS. 1A and 1B. FIG. 1A shows a partial cross section of a conventional stovetop fire suppressor for mounting under a vent-hood taken through the axial center. FIG. 1A is a cross sectional view taken along the center axis of a closed container automatic stovetop fire suppressor. Through the bottom wall or lid 20 of the container 40 extends a fuse 10. A fire on the stovetop ignites the fuse 10, which in turn detonates an initiator 30. The initiator 30 opens the bottom 20 of the container 40, thereby allowing the disbursement of the extinguishing agent 49 onto the fire and the stovetop. The container 40 is secured via a mounting assembly 50 to a hood over the stove. A clevis pin 52 that is installed through a hole in the center of the can top wall 48 is connected to the mounting assembly 50 via a ring 55. A magnetic housing 54 houses a magnet 51 which affixes the stovetop fire suppressor. Ring 55 connects to the magnet housing 54 via opening 59.

In practice the charge is ignited by the fuse and the activated initiator blows segments in the bottom lid open releasing the fire suppressing agent. With reference to FIG. 1B, a bottom lid 20 of a conventional stovetop fire suppressor is described in greater detail. FIG. 1B shows a bottom view of an outside of a container lid, in accordance with a conventional stovetop fire suppressor. Once assembled, the fuse extends through the lid 20 exposing its cut end past the outside side of the lid, fuse not shown. The bottom lid 20 has grooves or scored lines 41A-46A selectively formed on the outside thereof to facilitate breaking or rupturing of the bottom end into separate tear-open segments 41-46 without fragmentation to form openings 41B-46B, openings not shown, only in the bottom wall, lid 20, when the free ends of the segments are forced outward to allow the fire extinguishing powder 49, shown in FIG. 1A, to fall or pass outward from the container onto the fire. Although the scoring is illustrated on the outside surface of the lid it can be on the inside surface thereof. Reinforcing ribs 27WR extend between each segment 41-46 and merge into a center circle 27WR, as shown in FIG. 1B. The reinforcing ribs and circle 27WR, 27WR' can be indented or raised and provide a strengthened web between the weakened scored segments 41-46. The fuse 10, shown in FIGS. 1A and 1B, is lit by a stovetop fire which burns into the initiator 30 and ignites the charge 36. When this occurs, the force of the explosion ruptures the scored or weakened lines and forces the tear open segments 41-46 outward to form openings 41B-46B. The fire extinguishing powder 49 then falls out of container 40, shown in FIG. 1A, for example, to extinguish any fire below which may be on a stovetop, for example in a frying pan.

Figure 2A:
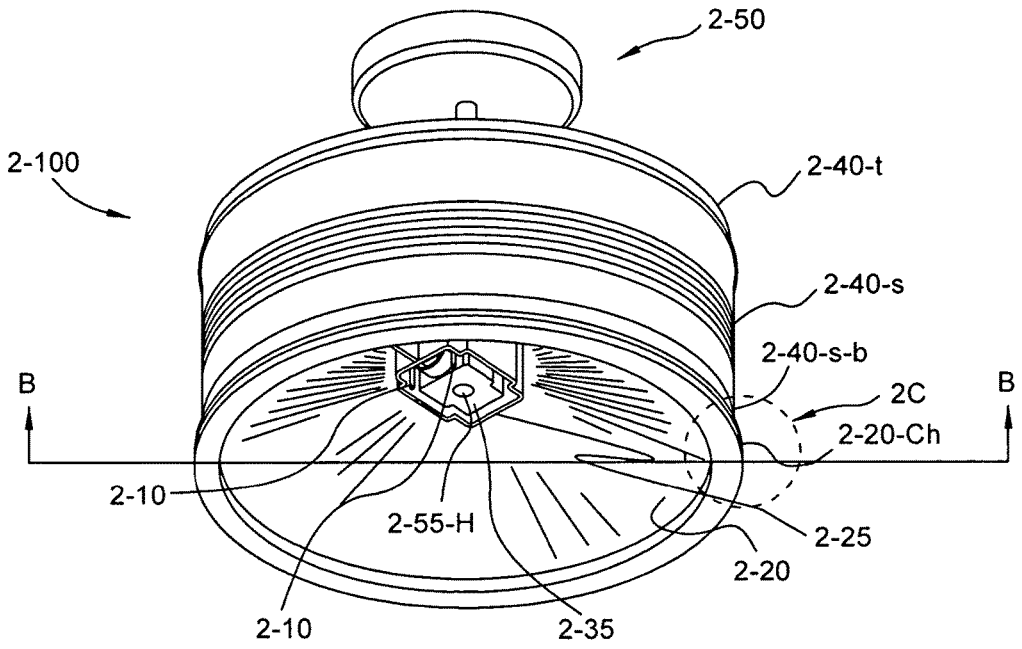
FIG. 2A shows a bottom perspective of an automatic stovetop fire suppressor in a closed state with a cone shaped bottom lid, a fuse, and a shuttle actuator, in accordance with an exemplary embodiment of the present invention.

FIG. 2A shows a bottom perspective of an automatic stovetop fire suppressor 2-100 in a closed state with a cone shaped bottom lid 2-20, a fuse 2-10, and a shuttle actuator 2-35, in accordance with an exemplary embodiment of the present invention. From the cone shaped bottom lid 2-20, moving towards that center, FIG. 2A shows a splash guard 2-25 surrounding at shuttle actuator 2-35. Two ends of a fuse 2-10, 2-10 extend out of the bottom of shuttle 2-35 facing the stovetop surface when mounted for fire suppression. The lid 2-20 is sealed to a container sidewall 2-40-S. A mounting assembly 2-50 is connected to the shuttle actuated fire suppressor 2-100 and is shown above a container top wall 2-40-*t*. A mounting assembly 2-50 is attached to the stovetop fire suppressor 2-100 and is shown extending above a top wall 2-40-*t*. When installed, the container 2-40 is secured via mounting assembly 2-50 to, for example, a hood over the stove with the fuse facing the cooking surface.

Figure 2B:
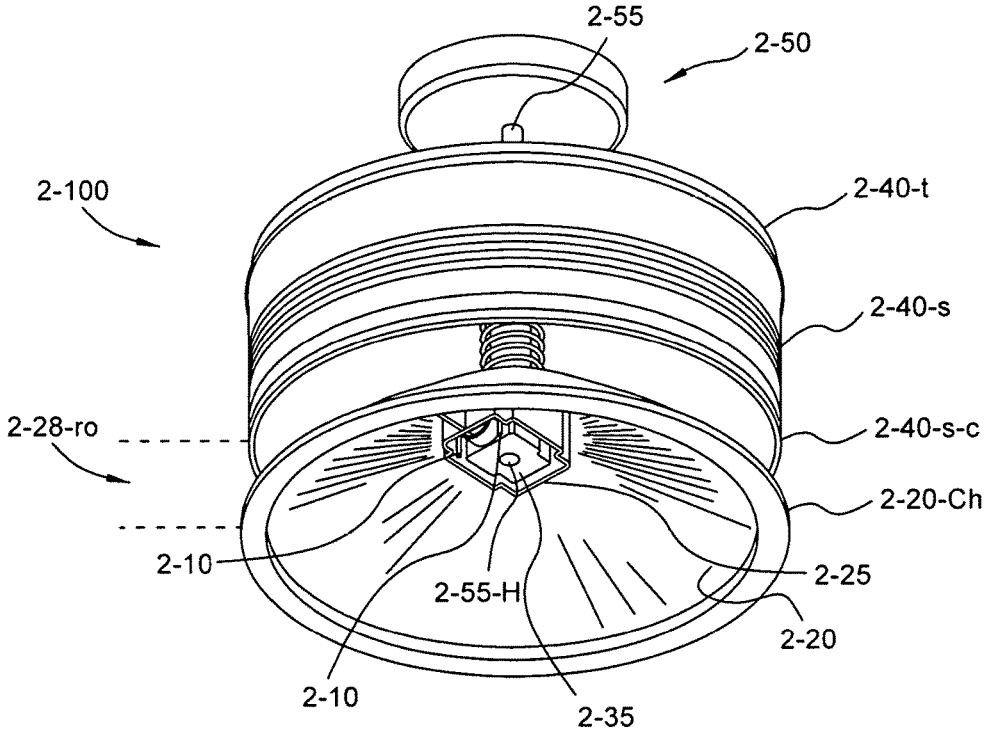
FIG. 2B shows a bottom perspective of an automatic stovetop fire suppressor in an open activated state with a cone shaped bottom lid, a fuse, and a shuttle actuator, in accordance with an exemplary embodiment of the present invention.

FIG. 2B shows a bottom perspective of an automatic stovetop fire suppressor 2-100 in an open activated state with a cone shaped bottom lid 20, a fuse 2-10, and a shuttle actuation 2-35, in accordance with an exemplary embodiment of the present invention. FIG. 2B shows the bottom lid 2-20 dropped below sidewall 2-40-S forming a radial opening 2-28-*ro*. Seen through the opening is a spring 2-30. The spring is compressed in the closed state of the fire suppressor but when the fuse lights and the shuttle displaces the support holding the spring in compression, the spring expands to break the seal between the lid circumference and the cylindrical sidewall and to lower the cone shaped bottom lid. Fire suppressing powder flows out of the radial opening 2-28-*ro* when the shuttle actuated stovetop fire suppressor 2-100 activates, as shown in FIG. 2B. The splash guard 2-25 and shuttle housing 2-35 remain in their same position relative to the cone shaped bottom lid 2-20. A mounting assembly 2-50 secures the fire suppressor 2-100 above the stovetop surface in practice. Two ends of a fuse 2-10 extend from the shuttle housing 2-35. The fuse is shown in an inactivated state for illustrative purposes. The bottom interface of the sidewall and bottom lid 2C is shown in more detail in FIG. 2C.

Figure 2C:
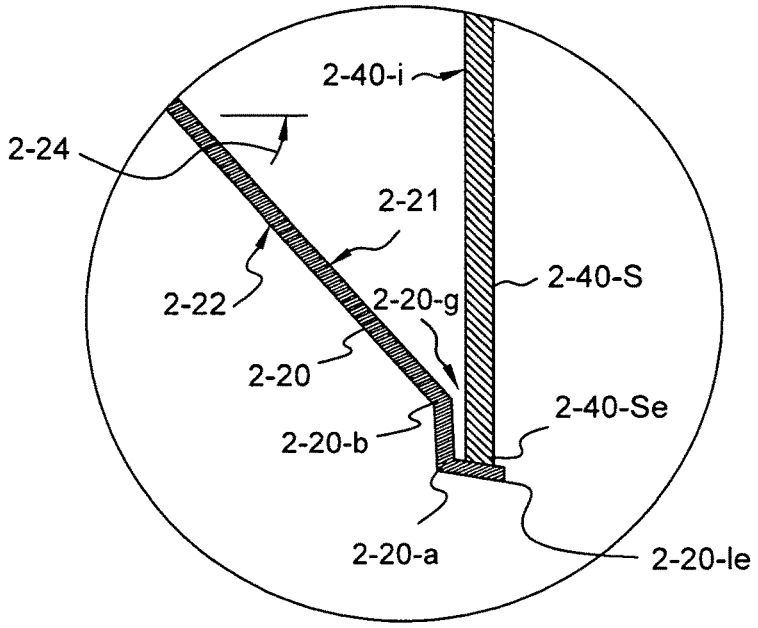
FIG. 2C shows a cross sectional view of the bottom sidewall and lid interface of the suppressor in FIG. 2A in more detail, in accordance with an exemplary embodiment of the present invention.

FIG. 2C shows a cross sectional view of the bottom sidewall and lid interface of FIG. 2B in more detail, in accordance with an exemplary embodiment of the present invention. FIG. 2C shows the interface between the outer edge of the cone lid 2-20 and the bottom of the can sidewall 2-40-*s*. The bottom edge 2-40-S-e of the sidewall 2-40-S is shown with a squared end. The outer circumference of the cone lid has a first and second bend 2-20-*b*, 2-20-*a* and forms a ledge beneath the bottom of the sidewall edge 2-40-Se. Ledge 2-20-*le* may be horizontal or may have a slant in the Z direction. In accordance with an exemplary embodiment, the cone shaped bottom lid 2-20 may have an angle 2-24 of 20 degrees. In alternate embodiments, the cone angle may be less than 20 degrees. In still alternate embodiments, the angle may be greater than 20 degrees. In accordance with the exemplary embodiment of FIG. 2C, a gap 2-20-*g* is present between the inner side 2-21 of the cone lid 2-20 and an inner side 2-40-*i* of the sidewall 2-40-S.

Figure 2D:
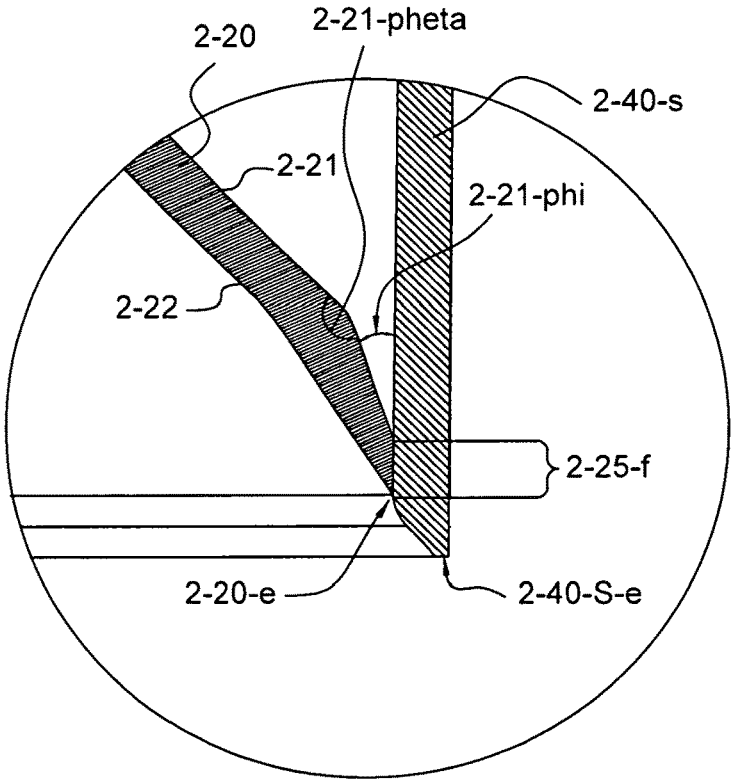
FIG. 2D shows a cross sectional view of the bottom sidewall and lid interface in an alternate embodiment, in accordance with the present invention.

FIG. 2D shows a cross sectional view of the bottom sidewall and lid interface in an alternate embodiment, in accordance with the present invention. FIG. 2D shows the interface between the outer edge of the cone lid 2-20-*e* and the bottom of the can sidewall 2-40-*s*, in accordance with an alternate embodiment of FIG. 2D, the bottom edge 2-40-S-e is chamfered on the inner circumference of the side wall 2-40-*s*. In alternate embodiments, alternate configurations of the bottom of the sidewall may be desired. For example, the configuration of the bottom edge of the sidewall may be rounded, not chamfered, straight, or may come to a point. Towards an outer circumference bottom lid 2-20 may bend 2-21-pheta. The outer edge of the cone lid 2-20-*e* tapers with an angle 2-21-phi. In accordance with an exemplary embodiment, angle pheta 2-21-pheta is 135 degrees and angle phi, 2-21-phi, is 30 degrees. The taper is cut to form a vertical face 2-25-*f* of the circumferential edge of the cone lid 2-20-*e*. End face 2-25-*f* is juxtaposition the inner sidewall 2-40-*s* when the fire suppressor device is in its closed inactivated state, as shown in FIG. 2D. A vertical Z distance between respective bottom edges 2-45-S-e, 2-20-*e* may vary across embodiments. The bottom edge of the side wall may include a curved region above or below a lid bottom edge 2-20-*e*. In still alternate embodiments, the bottom edge 2-40-S-e may be rounded.

Figure 3A:
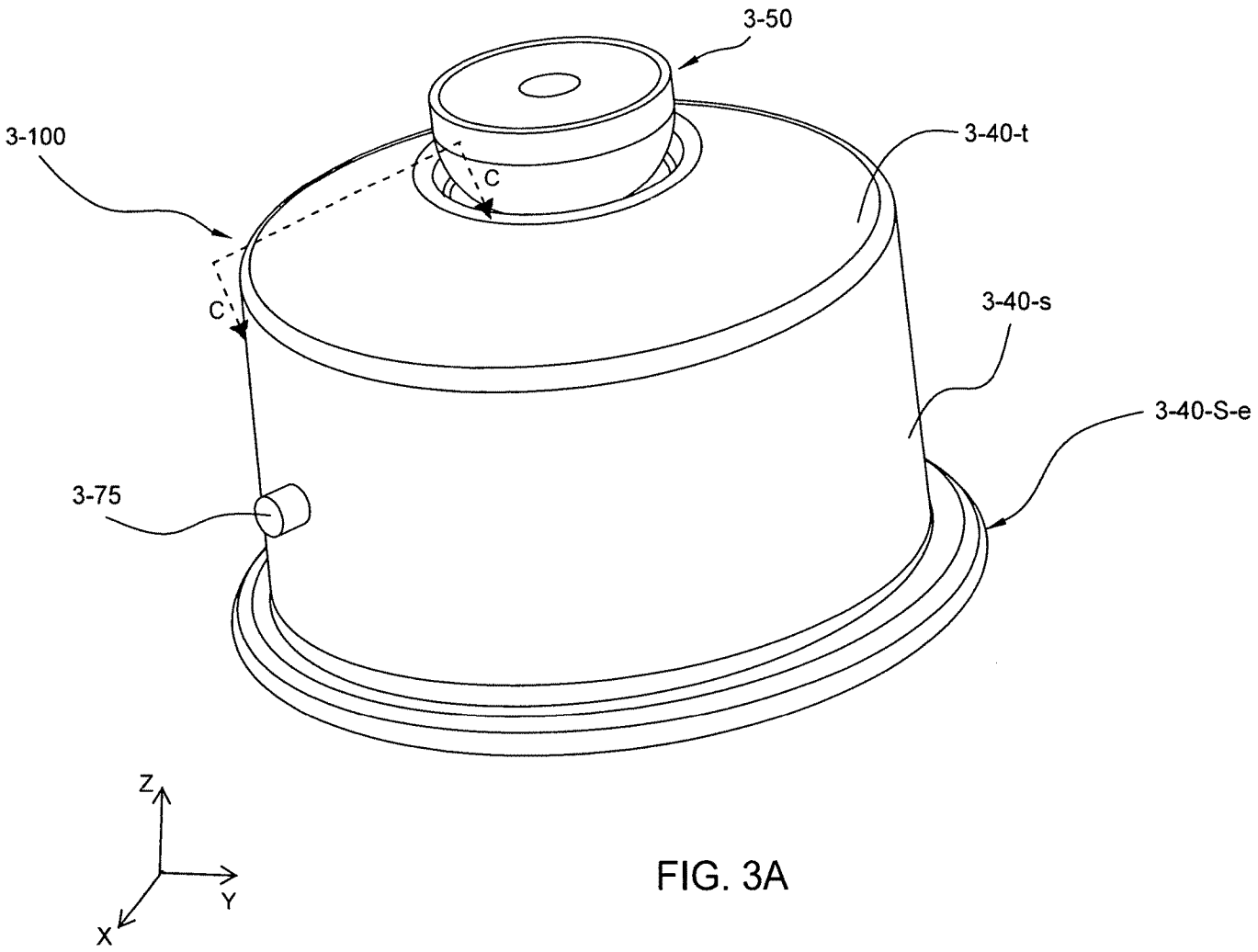
FIG. 3A shows a top perspective view of a stovetop fire suppressor, in accordance with an exemplary embodiment of the present invention.

FIG. 3A shows a top perspective view of a closed stovetop fire suppressor 3-100, in accordance with an exemplary embodiment of the present invention. From the top, +Z, a mounting assembly 3-50 is shown. The top wall 3-40-*t* and the sidewall 3-40-*s* of the fire suppressor container are identified. The bottom edge 3-40-S-e is shown aft and a push button 3-75 for the sound board, not shown, is seen in the foreground.

Figure 3B:
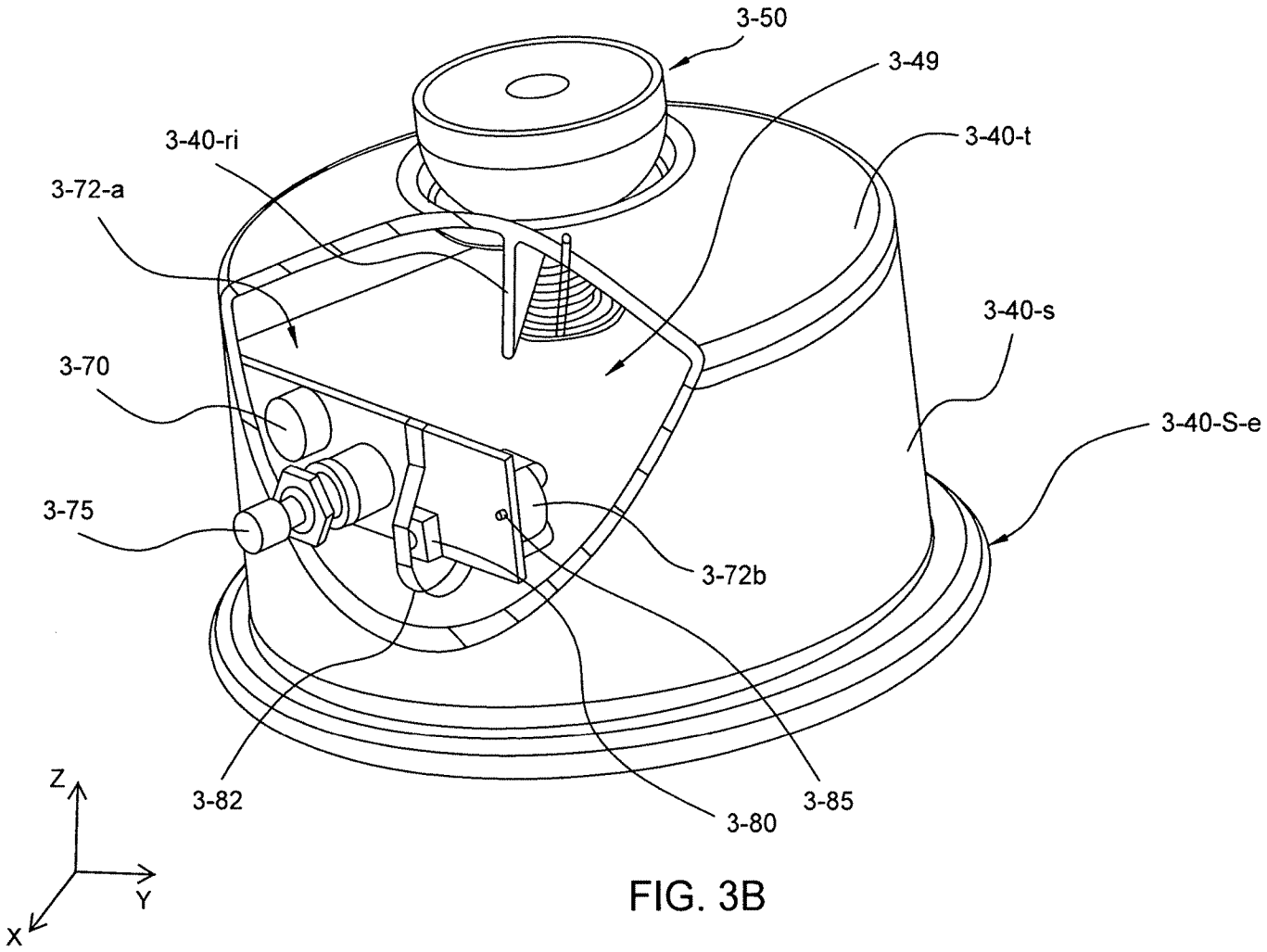
FIG. 3B shows the top perspective view of the stovetop fire suppressor in FIG. 3A, with a portion of the outer walls removed to expose a sound board, in accordance with an exemplary embodiment of the present invention.

FIG. 3B shows the top perspective view of the stovetop fire suppressor in FIG. 3A, with a portion of the outer walls 3-40-*t*, 3-40-*s* removed along line C-C to expose a sound board 3-85, in accordance with an exemplary embodiment of the present invention. In accordance with the exemplary embodiment of FIG. 3B, top wall 3-40-*t* may be nearly flat. In accordance with an alternate embodiment, the top wall 3-40-*t* may slope with its center portion, near mount 3-50, higher than the bend into sidewall 3-40-*s*. A push button switch 3-75 is shown in the foreground and connects to sound board 3-85. In accordance with an exemplary embodiment, two equal sized batteries 3-72*a*, 3-72*b* are mounted on opposite ends of the sound board 3-85. A transducer 3-70 is shown above +Z and left −Y of the push button 3-75. Moving right, +Y, of the switch 3-75 is an alarm activation assembly 3-80, 3-82 in accordance with an exemplary embodiment of the present invention. The activation assembly is described in greater detail with reference to FIGS. 4C-4E, below. A mount 3-50 for the stovetop fire suppressor 3-100 is shown at a top center. Integral to the top wall 3-40-*t*, a supporting rib 3-40-*ri* is shown. Embodiments of the present invention will clear supporting top wall ribs 3-40-*ri*, when the sound board is mounted in a stovetop fire suppressor containing the same.

Figure 4A:
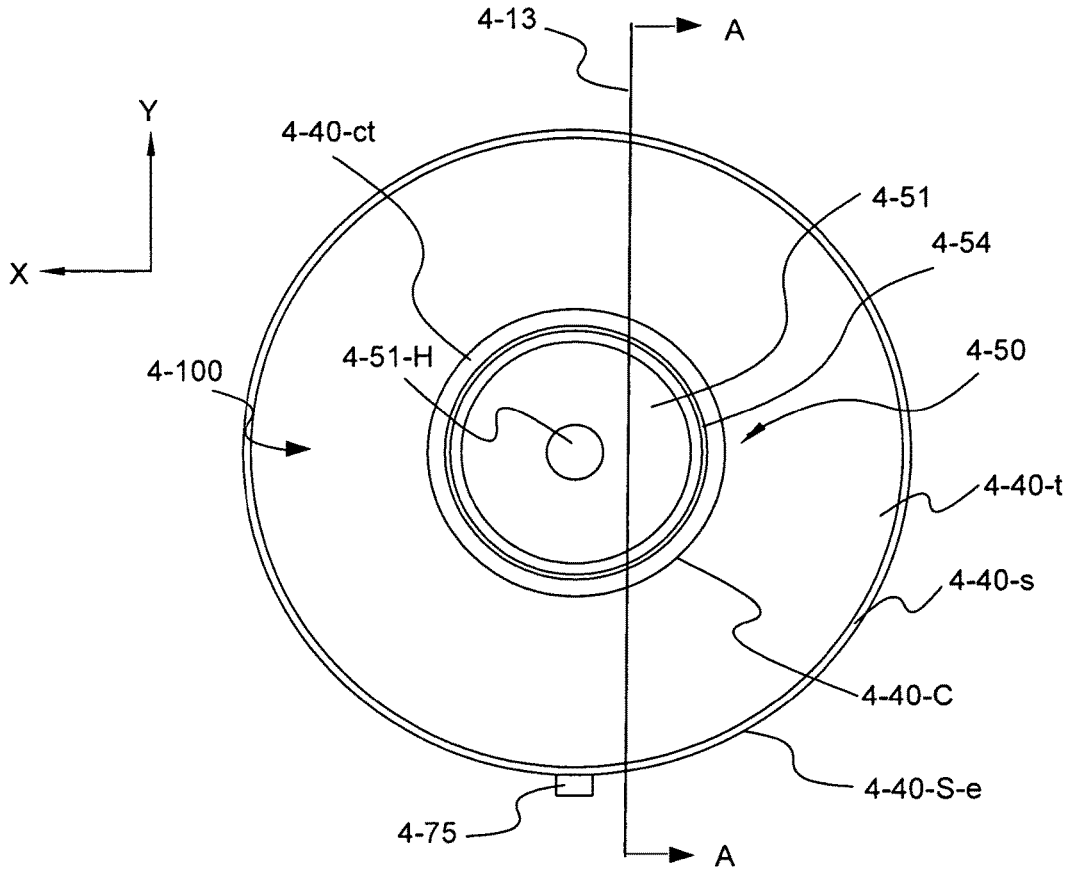
FIG. 4A shows a top view of a stovetop fire suppressor, in accordance with an exemplary embodiment of the present invention.
Figure 4B:
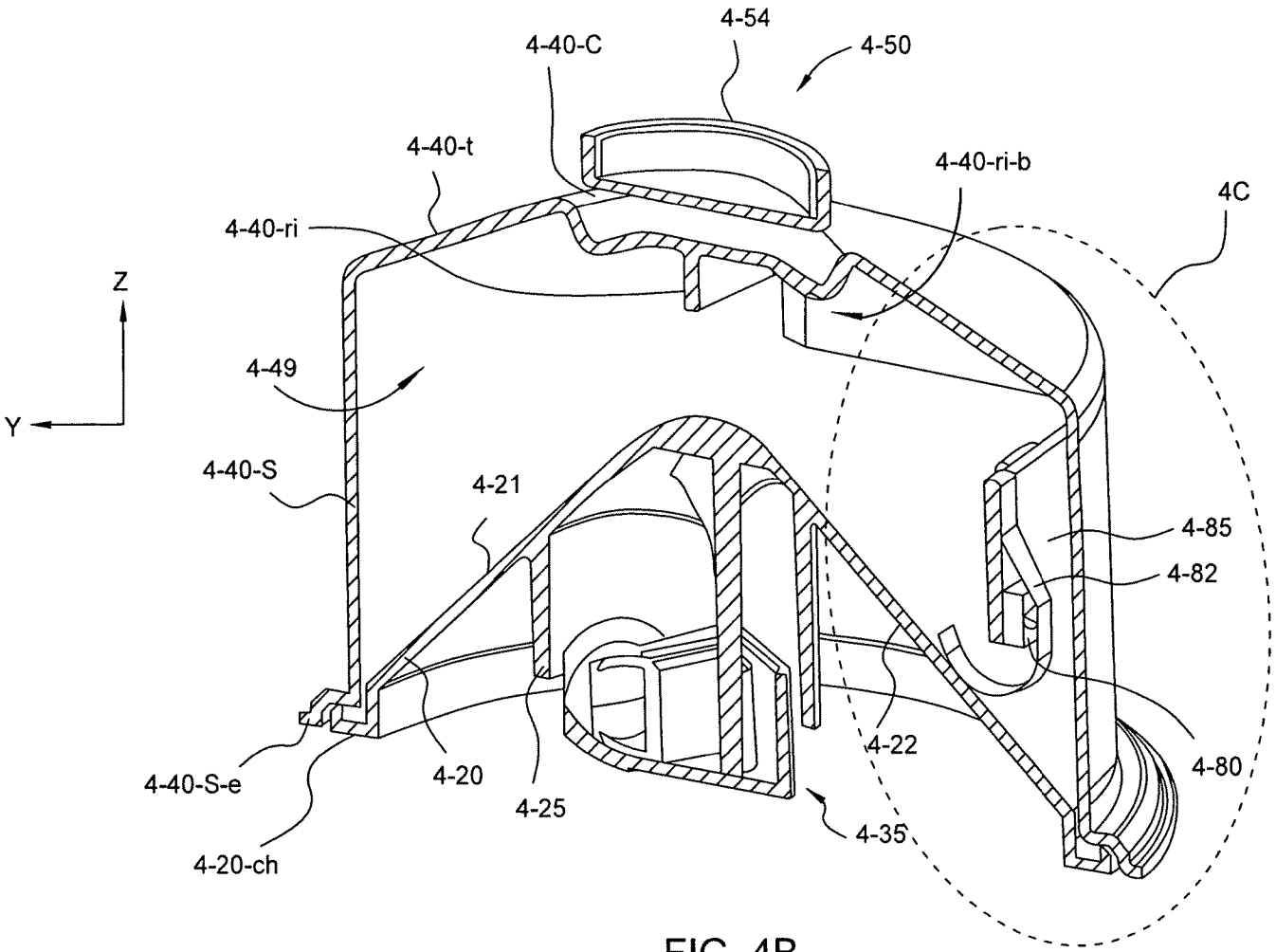
FIG. 4B shows a cross sectional view along line A-A in FIG. 4A of the an exemplary embodiment of the present invention.

FIG. 4A shows a top view of a stovetop fire suppressor 4-100, in accordance with an exemplary embodiment of the present invention. Parts of the mounting assembly 4-50 are shown in the device center. An edge of magnet housing 4-54 houses a donut shaped magnet 4-51, where the magnet faces upwards, +Z. An edge of the side wall 4-40-S-e is shown in the outer most circumference, with the container sidewall 4-40-S shown just inside said edge 4-40-S-e. Just outside housing 4-54 is an indent forming a cup 4-40-C in the container top wall 4-40-*t*. In accordance with the exemplary embodiment of FIG. 4A, the magnet 4-51 is donut shaped magnet. The housing 4-54 can fit inside, tilt inside, cup 4-40-C, in accordance with an exemplary embodiment. A circular magnet 4-51 is mounted in magnet housing 4-54. An exemplary push button 4-75 is shown on the −Y side of the top view. An exemplary configuration of the cup 4-40-C and magnet housing 4-54 are shown in more detail in FIGS. 4B and 4C. Cross sectional view line A-A 4-13 is shown just above the device center, relative to the XY view shown. FIGS. 4B and 4C show cross sectional views. The cup 4-40-C, the cup channel 4-40-*ct* and the magnet housing 4-54 are described in greater detail with reference to, for example, FIG. 4B shows a cross sectional view of an exemplary embodiment of the present invention, taken along line A-A, 4-13.

FIG. 4B shows a cross sectional view of an exemplary embodiment of the present invention taken along line A-A of FIG. 4A. From the bottom −Z, center, a shuttle actuation assembly 4-35 is shown within a cone shaped bottom lid 4-20. The lid has an outer side 4-22 which faces the heat source or cooking surface when mounted for use. In accordance with the exemplary embodiment of FIG. 4A, a splash guard 4-25 is integral to the cone shaped bottom lid 4-20 and circumscribes a shuttle assembly 4-35. At the outer circumference of the cone shaped bottom lid 4-20 a channel 4-20-*ch* meets with the sidewall 4-40-S of the fire suppressor 4-100 at a bottom sidewall edge 4-40-S-e. In accordance with an exemplary embodiment, a seal may be sandwiched between the channel 4-20-*ch* and sidewall bottom edge 4-40-S-e. From the top, a top wall 4-40-*t* bends into a sidewall 4-40-S and has an indented cup about its vertical, +Z, axis. A mounting assembly 4-50, above can top wall 4-40-*t*, +Z, can tilt into cup 4-40-C. In accordance with the exemplary embodiment of FIG. 4B, a supporting rib 4-40-*ri* is shown integral to the top wall 4-40-*t*. In accordance with exemplary embodiments, such ribs may extend to or near the sidewall, 4-40-S and may be three in number and spaced 120 degrees apart. In the view of FIG. 4B and in the embodiment thereof a second rib 4-40-*ri*-*b* is shown. In practice the suppressor cavity 4-49 is filled with a fire suppressing agent.

Turning to the cone shaped bottom lid, 4-20, a spring 4-82 is flexed upon an inner side 4-21 of the cone shaped lid 4-20. The compressed spring 4-82 suppresses switch 4-80. The position of the sound board and activation assembly in relation to the sidewall 4-40-S and bottom lid, area 4C, are shown in further detail in FIG. 4C. Switch activation for a sound alert is further described with reference to FIG. 4C below.

FIG. 4C shows the spring 4-82 activation of the sound board 4-85 of FIG. 4B in more detail, in accordance with an exemplary embodiment of the present invention. The board 4-85 fits into the interior cavity 4-49 and clears any ribs. The board 4-85 is spaced a vertical distance 4-85-*v*, +Z, from the inner 4-21 cone lid 4-21. An exemplary vertical distance 4-85-*v* is 0.625 inches. The board 4-85 is spaced a horizontal distance 4-85-*d*, −Y, from the container sidewall 4-40-S. A top 4-82-*t* of a spring 4-82 secures to the top of the sound board 4-85-*t*, and extends down a sound board 4-85 backside to depress a push bottom 4-80. Continuing past the push button 4-80, the spring curves 4-42-C and compresses upon an inner surface 4-21 of the cone shaped bottom lid 4-20 with the front of the spring 4-82-*a* extending above the cone lid surface 4-21 and in front, +Y, of the sound board 4-85. In accordance with an exemplary embodiment, the cone lid may have an angle 4-24 of 20 degrees. FIG. 4C shows the sound activation assembly in an off and loaded state with the fire suppressor 4-100 in its close inactivated state. In accordance with an exemplary embodiment, switch 4-80 is a normally closed spring loaded push button switch, activating upon release of the button. Spring 4-82, in accordance with an exemplary embodiment is a custom made metal flat spring with a top clip. An exemplary spring is shown in more detail in FIG. 4F.

FIG. 4F shows a front perspective view of an exemplary spring 4-82, in accordance with an exemplary embodiment of the present invention. The spring 4-82, has a top 4-82-*t* that is snug upon a top wall of a sound board, not shown, when assembled. A clip 4-82-*cl* secures the spring 4-82 to the sound board, not shown. A center axis 4-95 of the spring 4-82 runs along an end wall center 4-85-z, shown in FIG. 4C. Referring again to FIG. 4F, a spring length runs from a front end 4-82-*a* to 4-82-*a*' at clip 4-82-*cl* end. Spring 4-82 is shown in a compressed state in FIG. 4F and in a compressed and installed state in FIG. 4C. In the compressed state, the spring has a lower curve 4-82-C and a curve height 4-82-Ch. Further, still referring to FIG. 4G, a back 4-82-*b* of an exemplary spring has a top +Z outward bend, −Y, and lower −Z bend back to vertical, Y direction. In accordance with an exemplary embodiment, an exemplary spring length 4-82-*a* to 4-82-*a*' is 4.25 inches with a curve height 4-82-Ch of 0.5 inches when compressed and installed. In accordance with an exemplary embodiment, a normally closed spring loaded push button 4-80, shown in FIG. 4C, is compressed under an installed spring 4-82 with a horizontal compressed distance 4-82-*hp* of 0.4375 inches. With the same spring distance 4-82-*hp*, a perpendicular distance 4-85-*d*, shown in FIG. 4C, from spring axial center 4-95, shown in FIG. 4F, to container side wall 4-40-S is 0.625 inches. The push button, shown in FIG. 4C is shown in relation to an exemplary electrical sound board diagram in FIG. 6.

Figure 4D:
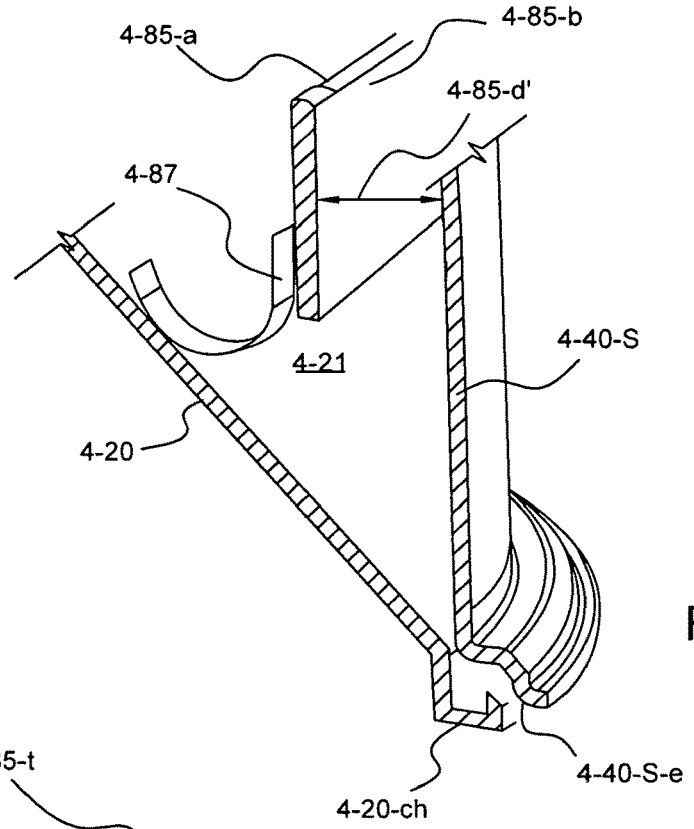
FIG. 4D shows an alternate embodiment of a sound board activation, the sound board housed in a closed fire suppressor container of FIG. 4C, in accordance with an exemplary embodiment of the present invention.
Figure 4E:
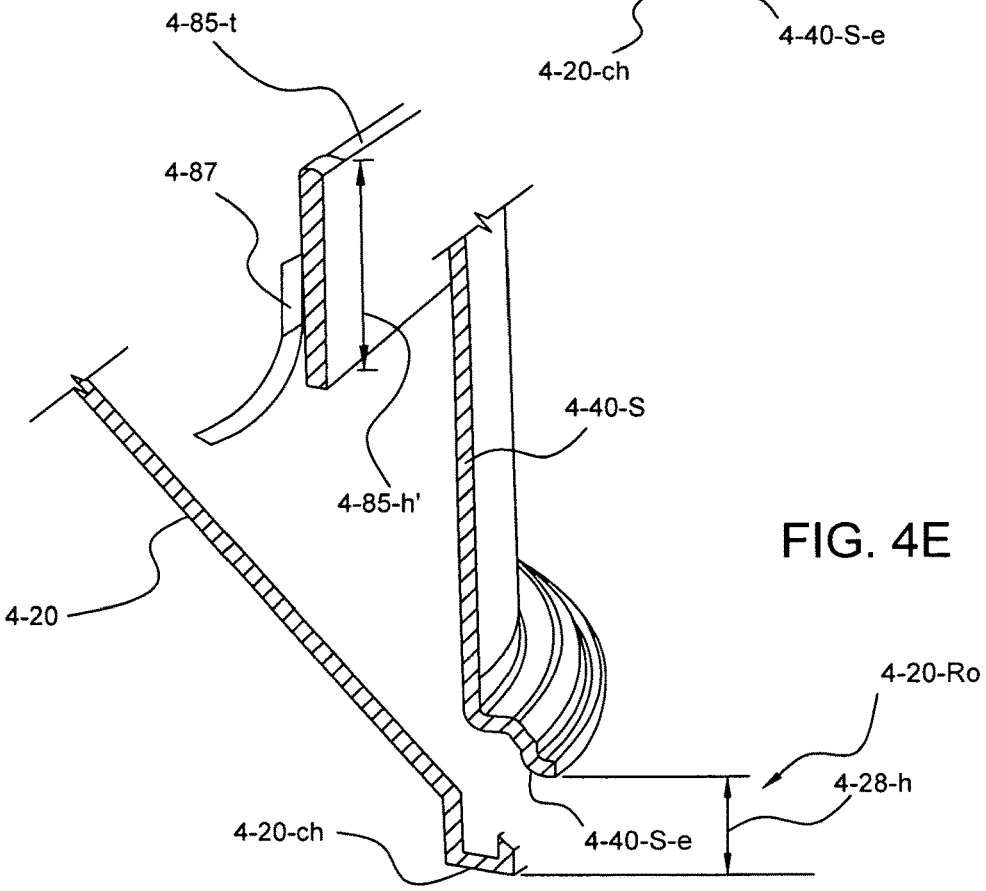
FIG. 4E shows an alternate embodiment of a sound board activation, the sound board housed in a deployed fire suppressor container of FIG. 4C, in accordance with an exemplary embodiment of the present invention.

FIGS. 4D and 4E show an alternate embodiment of sound board activation in a closed and an open activate state, respectively, in accordance with present invention from the view taken in FIG. 4C. Turning first to FIG. 4D, a spring limit switch 4-87 is held in its off position by an inner 4-21 side of the cone lid 4-20. Here, the switch 4-87 attaches to a front face 4-85-*a* of the sound board. In an alternate embodiment, a switch 4-87 may attach to a sound board backside 4-85-*b*. In accordance with an exemplary embodiment, a maximum perpendicular distance 4-85-*d*' from an inner sidewall 4-40-S to a sound board back side 4-85-*b* is 0.6 inches. A lid channel 4-20-*ch* and a sidewall 4-40-S-e are shown in a relative closed position. In practice, a seal may be seated in lid channel 4-20-*ch*.

Turning to FIG. 4E, the fire suppressor partial cross sectional view of FIG. 4D is shown in an open activated position. The sound board has a top 4-85-*t* maintains its position relative to and in the subject embodiment secured to the container sidewall 4-40-S. In accordance with an alternate embodiment, the sound board mounts to an inner face of the top wall, not shown. In accordance with an exemplary embodiment the sound wall height is 1.125 inches. The cone lid 4-20 has dropped upon activation of the fire suppressor. The lid 4-20 channel 4-20-*ch* drops below the sidewall edge 4-40-S-e forming a radial opening 4-20-Ro. In use, a fire suppressing agent, not shown, flows out of the radial opening. The switch 4-87 is triggered with the dropping of the lid 4-20. An audible alert signal begins with the trigger of 4-87. In accordance with an exemplary embodiment, the radial opening 4-20-Ro has a height 4-28-*h* of 0.6 inches.

Figure 5A:
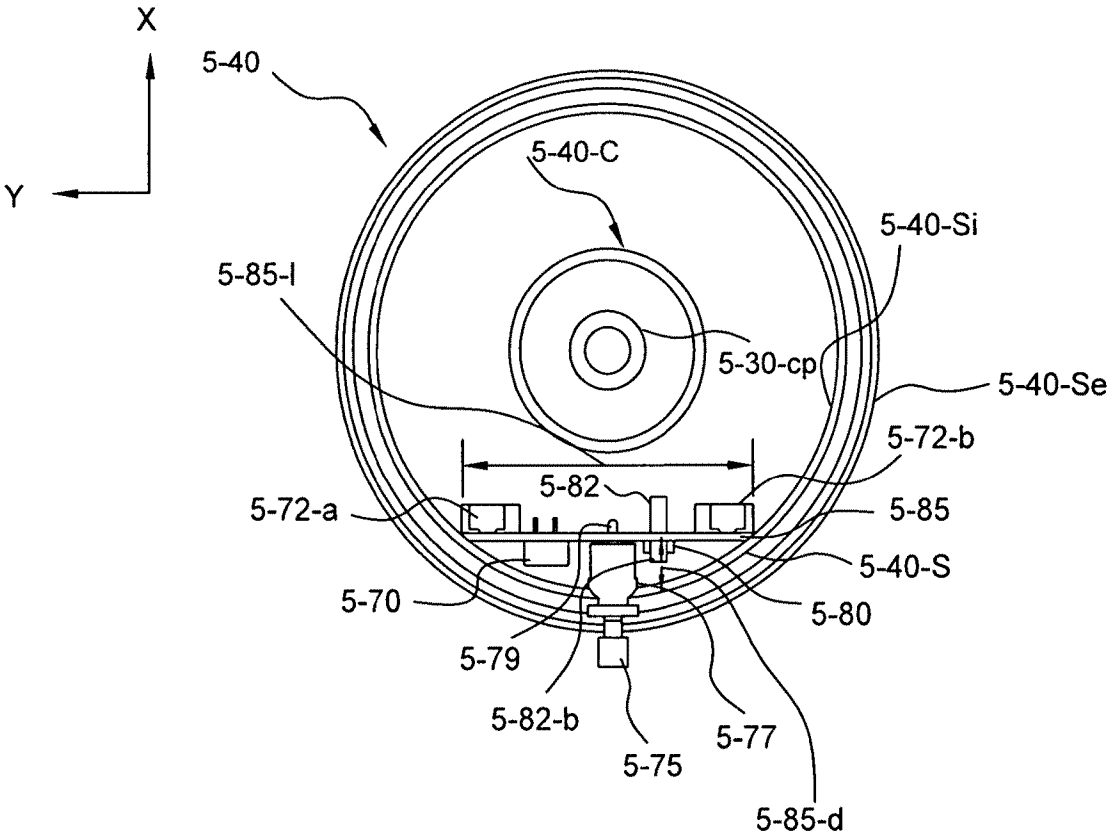
FIG. 5A shows a bottom view of an open container, in accordance with an exemplary embodiment of the present invention.

FIG. 5A shows a bottom view of an open container 5-40, in accordance with an exemplary embodiment of the present invention. At the outer most circumference is sidewall edge 5-40-Se. Sound board 5-85 rests against the inner side of the sidewall 5-40-Si. In accordance with an alternate embodiment, the sound board 5-85 clears the inner side of the sidewall 5-40-Si. A push button 5-75 provides the anchor point for the sound board 5-85 to the sidewall 5-40-S. A body shoulder 5-77 and electrical contact 5-59 of the push button 5-75 are shown. An exemplary push button is shown in greater detail in FIG. 5B. Referring again to FIG. SA, the sound board has an exemplary length 5-85-*l* of 2.0 inches. Mounted on the left and right +Y, −Y of the sound board 5-85 are equal sized batteries 5-72-*a*, 5-72-*b*, respectively. A transducer 5-70 is mounted on a container sidewall 5-40-S side of the sound board 5-85. Also shown are spring 5-82 and normally closed spring loaded push button 5-80.

Figure 5B:
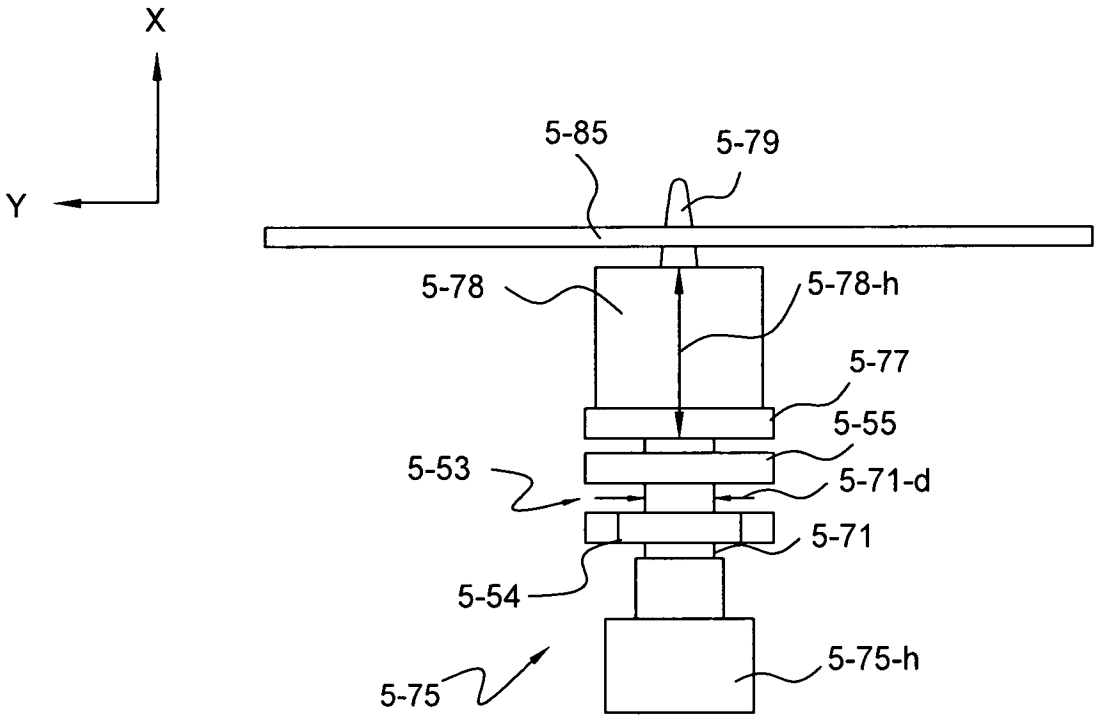
FIG. 5B shows a top view of a push button, in accordance with an exemplary embodiment of the present invention, in greater detail.

FIG. 5B shows a top view of a push button, in accordance with an exemplary embodiment of the present invention, in greater detail. The push button switch 5-75 has a head 5-75-*h* for user activation of the sound board 5-85. The switch 5-75 is electrically connected to the sound board 5-85 and its electrical contact 5-79 is shown aft. Running the length of the switch 5-75 is the button shaft 5-71. In accordance with an exemplary embodiment, the shaft 5-71 has a constant diameter 5-71-*d* of near 0.125 inches. In accordance with an exemplary embodiment, a flexible polymer type washer 5-55 may be aft, +X, of the nut 5-54 and forward, −X, of a button shoulder 5-77. When mounted in the fire suppressor, shaft 5-71 passes through a hole in a container sidewall, not shown, and is sandwiched between washer 5-55 and nut 5-54, filling space 5-53. A height 5-78-*h* of a switch body 5-78 provides the perpendicular separation of the sound board 5-85 to the container sidewall, not shown. An exemplary height 5-78-*h* of the switch body 5-78 is 0.63 inches. In accordance with an exemplary embodiment, the switch 5-75 is centered in the Y direction about the X axis. In alternate embodiments, the switch body height is higher and can accommodate a longer sound board, while in still alternate embodiments, the sound board mounts closer to the container sidewall, not shown. Other dimensions of the switch may also vary across alternate embodiments.

Figure 6:
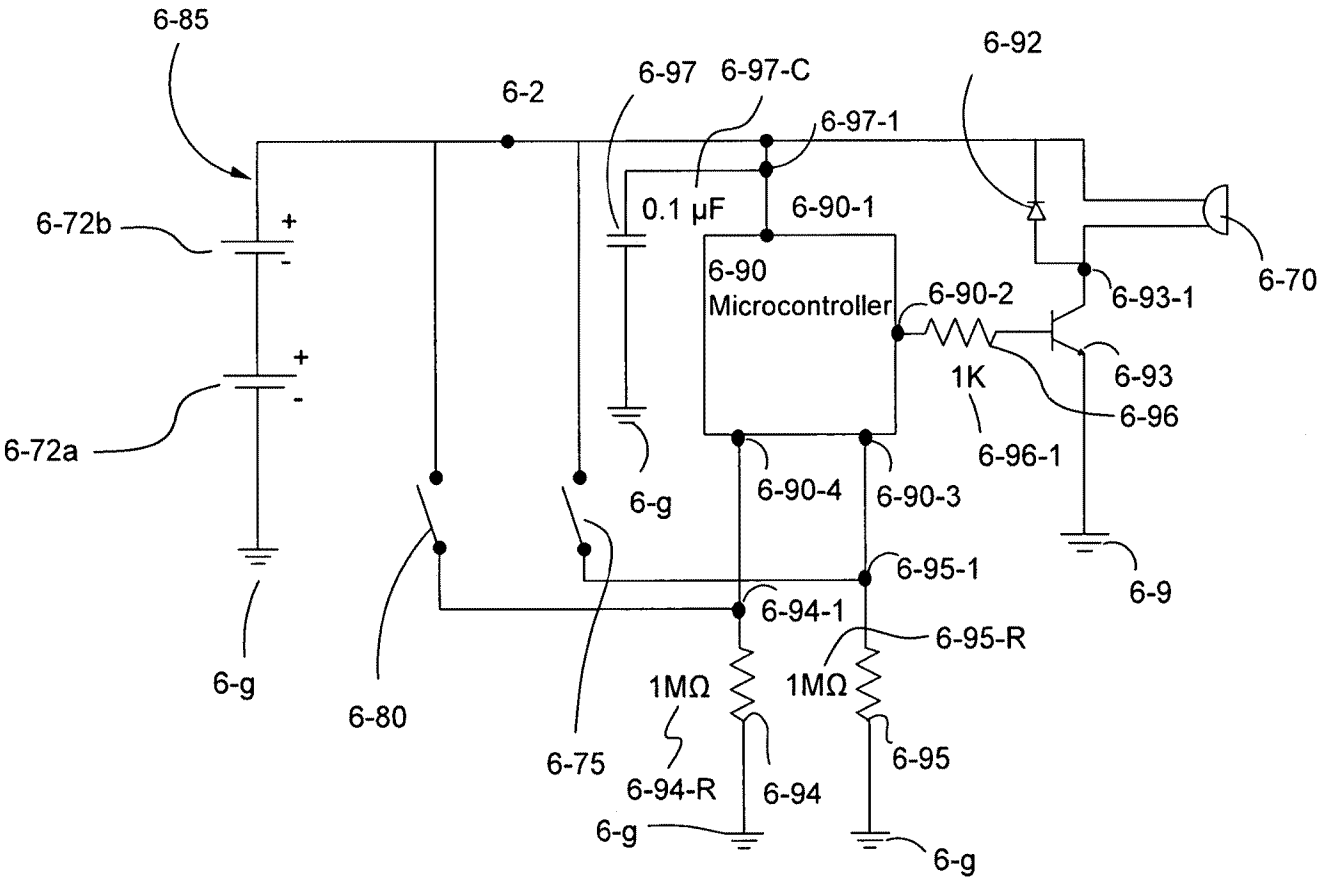
FIG. 6 shows an electrical diagram of exemplary sound board components, in accordance with an exemplary embodiment of the present invention.

FIG. 6 shows an electrical diagram of exemplary sound board components, in accordance with an exemplary embodiment of the present invention. In accordance with an exemplary embodiment, the sound board includes an off the shelf microcontroller 6-90. Three inputs are shown into the microcontroller, 6-90-1, 6-90-4, 6-90-3 with an output 6-90-2 feeding an acoustic transducer 6-70. Pull down resisters 6-94 and 6-95 connect both to microcontroller inputs 6-90-4 and 6-90-3, respectively, and to switches 6-80 and 6-75, respectively. Switch 6-80 is a normally closed spring loaded push button that activates the sound board when the bottom lid, 4-20 shown in FIG. 4C, lowers. Referring again to FIG. 6, switch 6-75 is a push button switch for manual activation of the sound board 6-85. In accordance with an exemplary embodiment, a 1 M ohm 6-94-R pull down resistor 6-94 is connected to the deployment 6-80 switch. And another 1 M ohm 6-95-R pull down resistor 6-95 is connected to the self-test, user activated, switch 6-75. These pull down resisters 6-94, 6-95 hold the microcontroller input pins 6-90-4, 6-90-3 low until switch 6-80, 6-75 activation. In an alternate embodiment, internal pull down resistors inside the microcontroller may be used in the absence of external pull down resistors 6-94, 6-95. While using internal resistors may save some costs, 1M ohm external resistors may reduce power consumption. Pull down resistors 6-94, 6-95 are tied to ground 6-*g* at respective non-switch ends.

Turning to output 6-90-2, a resistor 6-96 connects to base of transistor 6-93. The emitter of transistor 6-93 is tied to ground and the collector is tied to both 6-93-1 an acoustic transducer 6-70 and to diode 6-92. Resistor 6-90-2, transistor 6-93, and diode 6-92 amplify the drive current afforded by the microcontroller 6-90. In accordance with an exemplary embodiment, transducer 6-70 is a magnetic transducer that can operate at a low voltage of near 1 V. An off the shelf magnetic transducer can provide a more compact profile as compared to a piezo transducer, for example. Referring again to FIG. 6, a 0.1 μF 6-97-C capacitor 6-97 provides the decoupling used by the microcontroller. In alternate embodiments, alternate capacitor decoupling sizes may be desired. In accordance with an exemplary embodiment, microcontroller 6-90 may be a mixed signal ultra-low low power consumption microcontroller, such as an MSP430G2001 (TEXAS INSTRUMENTS, Dallas, Tex. U.S.) Referring again to FIG. 6 and in accordance with an exemplary embodiment, two coin cell batteries 6-72*a*, 6-72*b* are connected in series and connect to upper node 6-2 off the positive side and are tied to ground 6-*g* on the negative side. In accordance with an exemplary embodiment, each battery 6-72*a*, 6-72*b* is 1.5 volts. In accordance with the exemplary embodiment shown in FIG. 6, the decoupling capacitor 6-97 connects to node 6-2 via node 6-97-1 and drops to ground 6-*g*, in parallel with batteries 6-72*a*, 6-72*b*. Placement of electrical components on the sound board 5-85, shown for example in FIG. 5A, promote balance about the anchor point.

Figure 7:
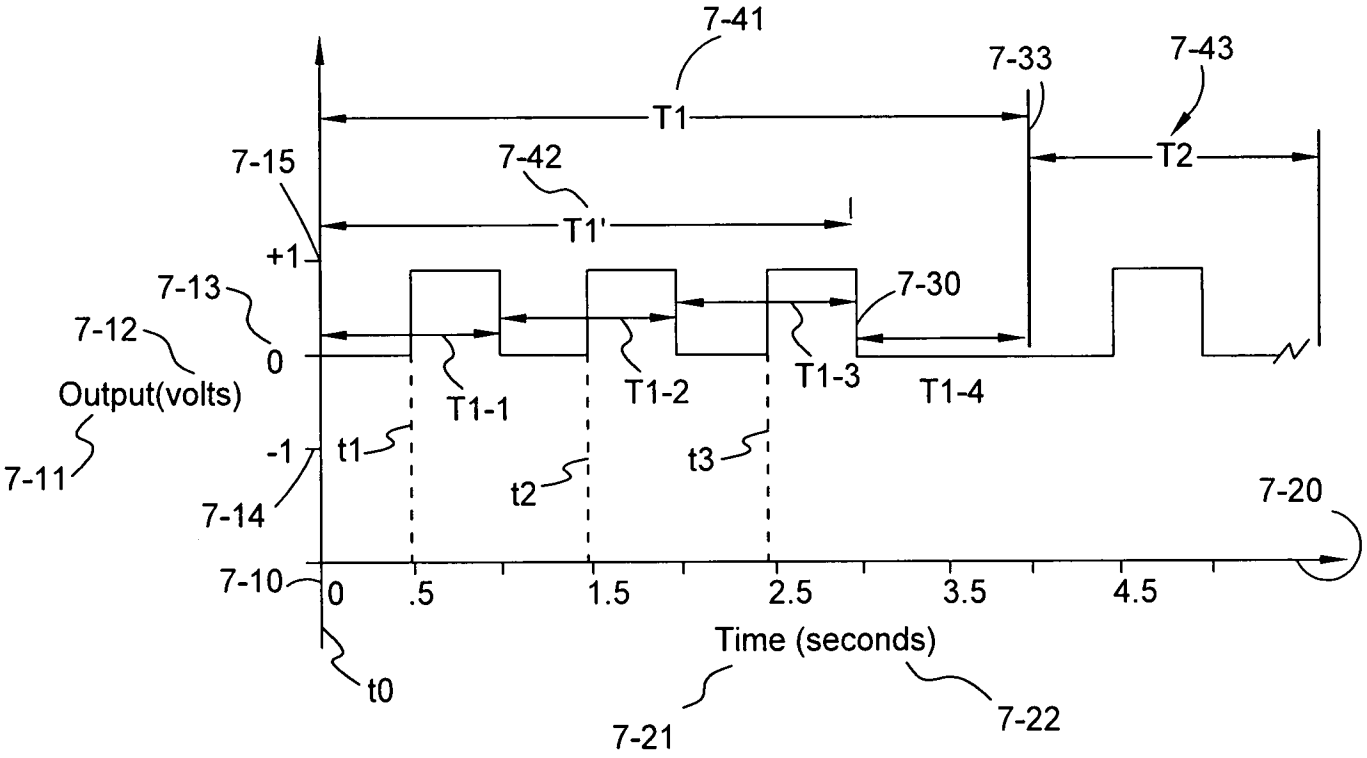
FIG. 7 shows a fire condition alert signal as a function of time, in accordance with an exemplary embodiment of the present invention.

FIG. 7 shows a fire condition alert signal as a function of time, in accordance with an exemplary embodiment of the present invention. Output 7-11 in volts 7-12 is shown as the ordinate axis 7-10 as a function of time 7-21 in seconds 7-22 on the abscissa axis 7-20. In accordance with the exemplary embodiment of FIG. 7, a square wave from zero 7-13 to near +1 volts 7-15 is output from the microcontroller. An entire first period T1 7-41 is shown from 0 seconds at t0 to 4.0 seconds 7-33. The period T1 starts with a zero volt output and goes hi at time equals 0.5 seconds for 0.5 seconds T1-1, and the same square wave repeats for T1-2 and T1-3 with the output switching hi at t2 1.5 seconds and t3 2.5 seconds. At 3.0 seconds, the end of T1-2, 7-30 3.0 seconds the output drops to zero volts and holds a zero volt output for 1 second T1-4 from 3.0 to 4.0 seconds 7-33. The signal of three square waves followed by a zero volt dead time equal to a square wave duration repeats, for example at T2 7-43. In alternate embodiments, three identical pulses followed by a dead time near that of a single wave period will form a fire alert signal. In alternate embodiments, the signal need not comprise square waves and the total T1 period my range from, for example, 2.5 to 4.5 seconds. In accordance with an exemplary embodiment comprising a three volt battery source, a square wave from zero to three volts would be generated dropping to zero to 1.8 volts as the battery power dissipates over time.

Figure 8A:
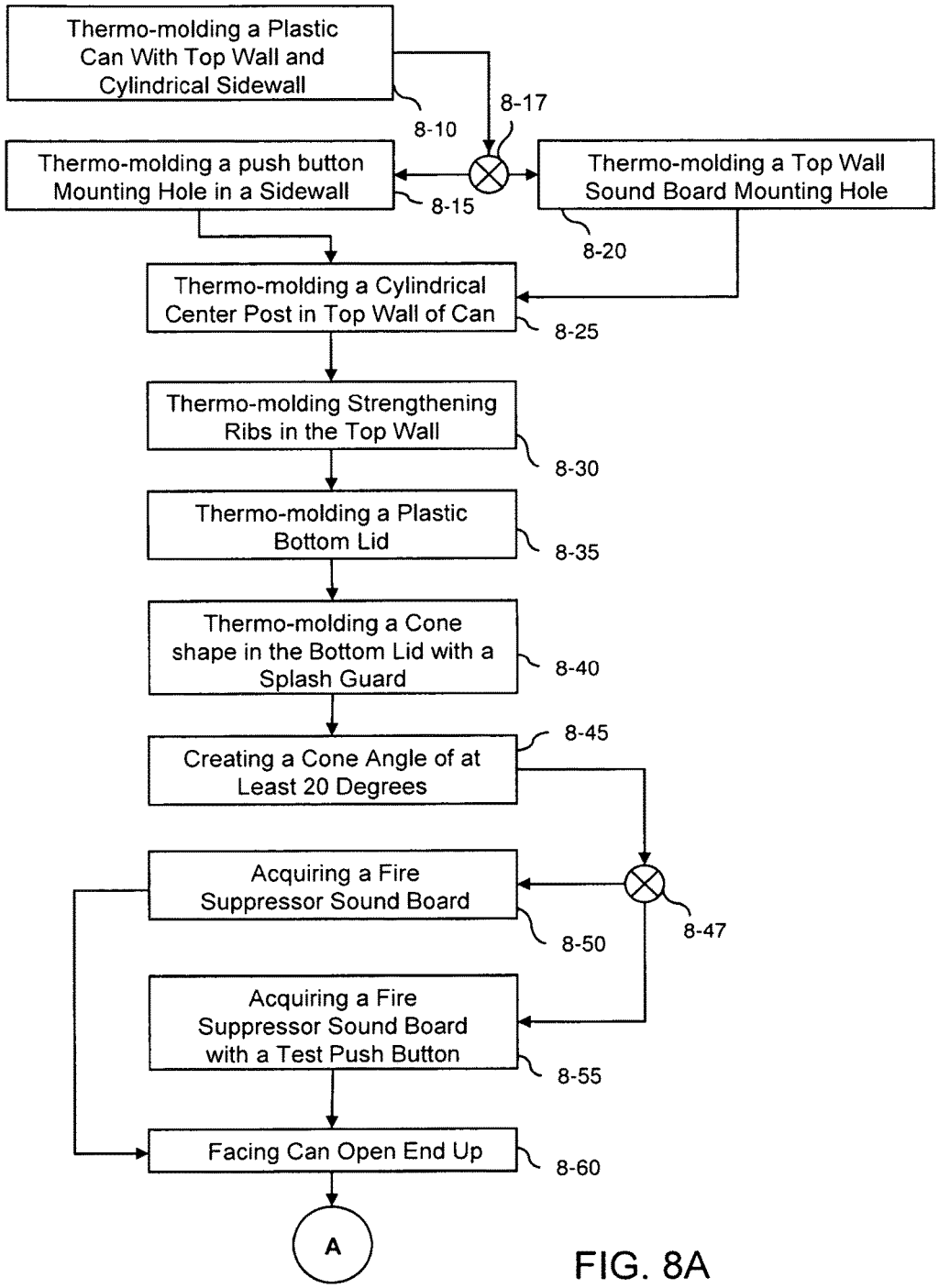
FIGS. 8A-8B show an exemplary method of manufacturing an automatic stovetop fire suppressor with sound alert, in accordance with an exemplary embodiment of the present invention
Figure 8B:
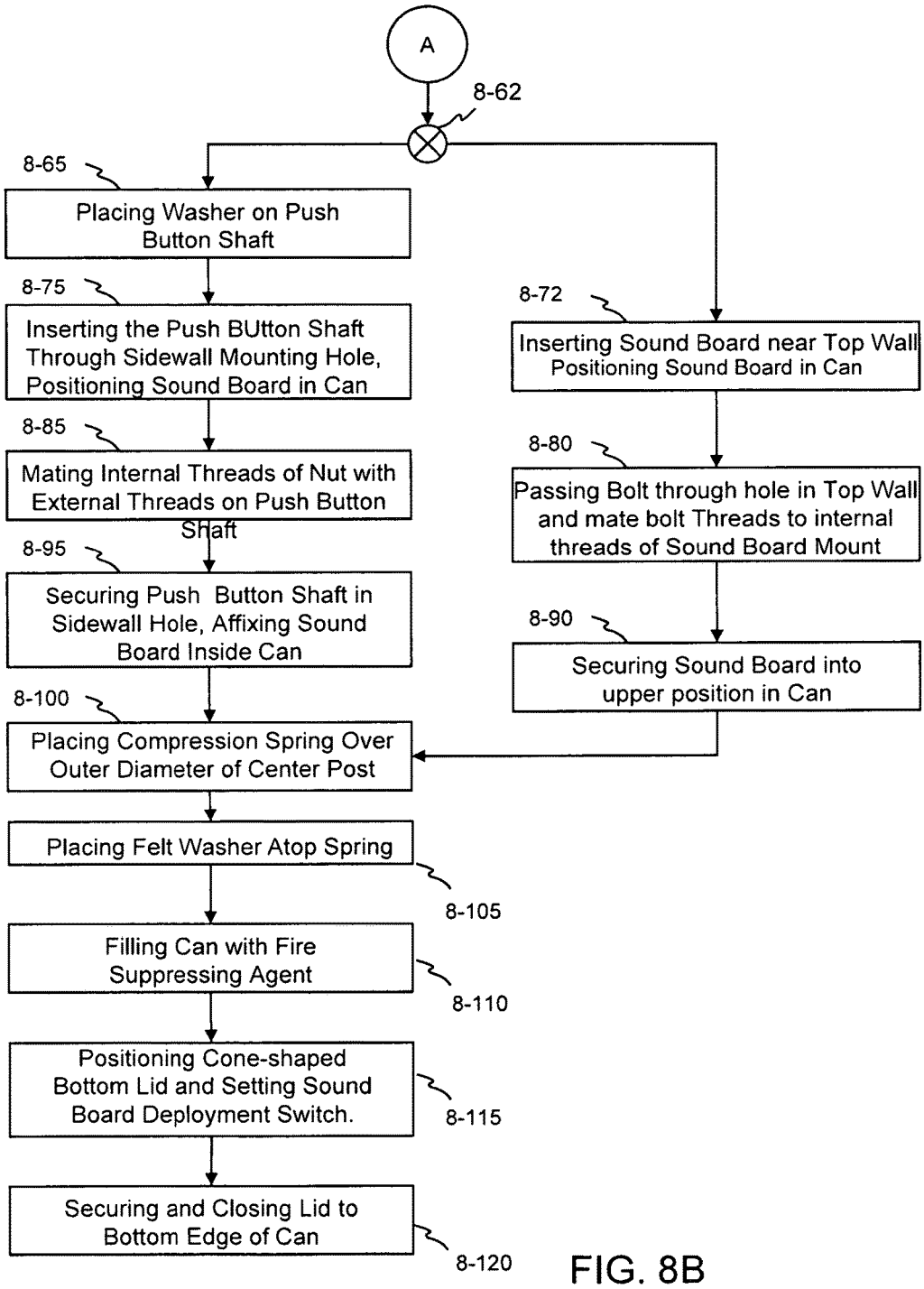

FIGS. 8A-8B show a method of manufacturing a self-contained stovetop fire suppressor with sound alert signal, in accordance with an exemplary embodiment of the present invention. The manufacturing method includes: thermo-molding a plastic can with top wall and cylindrical side walls 8-10; thermo-molding a push button mounting hole in a sidewall 8-15 or 8-17 thermo-molding a top wall sound board mounting hole 8-20.

The method may further include: thermo-molding a cylindrical center post with hollow center, in a top wall of can 8-25; In accordance with an exemplary embodiment, the cylindrical center post is integral to the top wall. Referring again to FIG. 8A, the manufacturing method further includes: thermo-molding strengthening ribs in the top wall of the can 8-30; thermo-molding a plastic bottom lid 8-35; thermo-molding a cone shaped bottom lid with a splash guard 8-40; creating a cone angle of at least 20 degrees 8-45. The method further includes: acquiring a fire suppressor sound board 8-50 or 8-47 acquiring a fire suppressor with a test push button sound board 8-55; and facing the can open end up 8-60.

The manufacturing method may further include: placing a washer on the push button shaft 8-65; inserting the push button shaft through sidewall mount hole, positioning sound board in can 8-75; mating internal threads of nut with external threads on push button shaft 8-85; securing push button shaft in sidewall hole, affixing sound board inside can 8-95. Or 8-62, in an alternate embodiment, the manufacturing method may further include: inserting sound board near top wall, positioning sound board in can 8-72; passing bolt through hole in top wall and mating bolt threads to internal threads of sound board mount 8-80; and securing sound board into upper position in can 8-90. Whether a top mount or 8-62 a push button sidewall mount, an exemplary manufacturing method may include: placing compression spring over outer diameter of center post 8-100; placing felt washer atop spring 8-105; filling can with fire suppressing agent 8-110; position cone-shaped bottom lid and setting sound board deployment switch 8-115; and securing and closing lid to bottom edge of can 8-120.

In accordance with an alternate embodiment of the present invention, the plastic bottom lid lacks a cone shape or has a low cone-shape angle 4-24, shown for example in FIG. 4C, less than 20 degrees.

Figure 9:
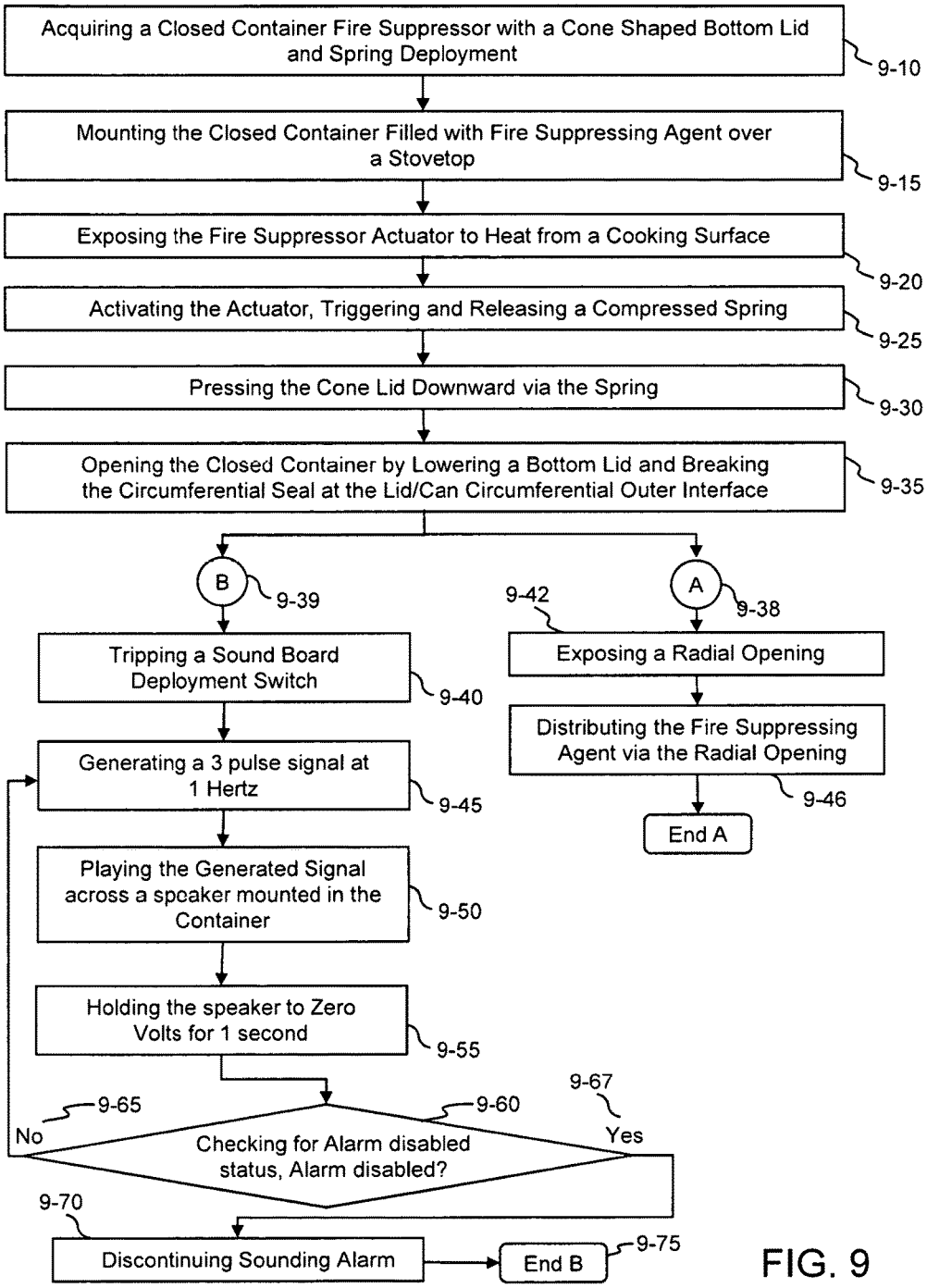

FIG. 9 shows an exemplary method of automatically sounding a fire alert in a deployed self-contained stovetop fire suppressor, in accordance with the present invention. A method of sounding a fire alert, in accordance with an exemplary embodiment includes: acquiring a closed container fire suppressor with cone shaped bottom lid 9-10; mounting the closed container filled with fire suppressing agent over a stovetop 9-15; exposing a fire suppressor actuator to heat from a cooking surface 9-20; activating the actuator, triggering and releasing a compressed spring 9-25; pressing the cone lid downward via the spring 9-30; and opening the closed container by lowering a bottom lid 9-35. In accordance with an alternate embodiment, a circumferential seal is broken as the lid lowers. In yet another alternate embodiment, the bottom lid need not have a cone shape. In still another embodiment, the fire suppressor actuator is a thermal glass bulb. With the lowering of the lid 9-35, fire suppressing agent is released 9-38 and the sound board is deployed 9-39. The exemplary method further includes: exposing a radial opening 9-42; and distributing the fire suppressing agent via the radial opening 9-46. As the lid lowers 9-35, the exemplary method further includes: tripping a sound board deployment switch 9-40; generating a 3 pulse signal at 1 hertz 9-45; playing the generated signal across a speaker mounted in the container 9-50; and holding the speaker to zero volts for 1 second after the 3 pulses play 9-55. The exemplary method further includes: checking for alarm disabled status 9-60. If the alarm is disabled 9-67, then discontinuing sounding the alarm 9-70; and end 9-75. Or if the alarm is not disabled 9-65, then returning to generating a 3 pulse signal at 1 hertz 9-45 followed by held to zero volts for 1 second. In accordance with alternate embodiments, a repeat of a signal wave is generated three consecutive times followed by a single signal period held to a zero volt, or otherwise no sound, output.

In accordance with an alternate embodiment, a piezo transducer that requires a higher voltage, for example 3 V can provide the sound alarm desired. In still alternate embodiments a high volume 10 V piezo transducer may be driven by the sound board.

In accordance with alternate embodiments of the present invention, a rectangular sound board may anchor to a container top wall to an internal rib. Alternate embodiments may also employ a different sound board configuration, such as a large washer shaped board circumscribing the center post. In still alternate embodiments, a magnetic switch may be mounted in, for example, gap 2-20-*g* shown in FIG. 2C, for sound board activation. Upon fire suppressor deployment and lowering of the cone lid 2-20, the break across a switch mounted in gap 2-20-*g* could trigger generation of the audio fire condition alert signal. Referring to FIG. 2D, a switch could be mounted within angle 2-21-phi. As the lid lowers, connection across the switch mounted within angle phi may be used to trigger the fire condition alert signal.

In accordance with exemplary embodiments of the present invention, a microcontroller provides low battery detection and a low battery alert is, in turn, sounded. Exemplary serviceable life may be five years. Low battery threshold may be 1.8 volts or less from an initial 6 volt source, from, for example, two 3 volt coin batteries in series. Referring to FIG. 5A, push button 5-75, may provide user confirmation of battery level and sound board function. Push button 5-75, in accordance with an exemplary embodiment, may also function as the user interface to discontinue the fire alert signal after fire suppressor deployment. In accordance with alternate embodiments, an externally accessible push button is omitted. As an alternative, deployment of the fire suppressor may expose an alternate user interface button for sound inactivation.

By implementing an activation process which incorporates the release of compressed spring energy to deploy a lower a bottom lid, the present invention can employ a sound board for a fire condition alert signal. Deployment of the automatic fire suppressor triggers an audio alert signal to sound until manually inactivated. Embodiments of the present fire suppressor invention provide predictable, consistent, and early fire condition alert to surrounding occupants. A self-contained stovetop fire suppressor which affords high safety, reliability, and performance is achieved through the present invention.

While a cylinder shaped can with round bottom lid forming a closed container have been shown and described herein, alternate three dimensional shapes may be readily employed by exemplary embodiments of the present invention.

While specific alternatives to steps of the invention have been described herein, additional alternatives not specifically disclosed but known in the art are intended to fall within the scope of the invention. Thus, it is understood that other applications of the present invention will be apparent to those skilled in the art upon reading the described embodiments and after consideration of the appended drawings.

What is claimed is:

1. An automatic stovetop fire suppressor, the device comprising:
- a thermo-molded plastic can comprising a top wall and a cylindrical sidewall:
  - a plastic cone shaped bottom lid secured to a bottom of the can and forming a closed container;
  - a fire suppressing agent housed in the closed container;
  - a sound board mounted in the closed container: and a spring compressing a sound activation button in the closed container.

2. The device according to claim 1, wherein:
- the spring releases the sound activation button when the closed container opens.

3. An automatic stovetop fire suppressor, the device comprising:
- a thermo-molded plastic can comprising a top wall and a cylindrical sidewall:
  - a plastic cone shaped bottom lid secured to a bottom of the can and forming a closed container;
  - a fire suppressing agent housed in the closed container;
  - a sound board mounted in the closed container: and
  - a limit switch triggered by lowering of the bottom lid activating the sound board.

4. An automatic stovetop fire suppressor, the device comprising:
- a thermo-molded plastic can comprising a top wall and a cylindrical sidewall:
- a plastic cone shaped bottom lid secured to a bottom of the can and forming a closed container;
- a fire suppressing agent housed in the closed container;
- a sound board mounted in the closed container:
- an at least two 1.5 volt coin batteries:
- a center axis mount on the sound board:
- wherein, the sound board is anchored to a cylindrical sidewall; and
- a first and a second coin battery mounted equidistant on the sound board about the center axis mount.

5. An automatic stovetop fire suppressor, the device comprising:
- a thermo-molded plastic can comprising a top wall and a cylindrical sidewall;

a plastic cone shaped bottom lid secured to a bottom of the can and forming a closed container;

a fire suppressing agent housed in the closed container;

a sound board mounted in the closed container;

a user test push button electrically connected to the sound board; and a trigger switch electrically connected to the sound board and mechanically activated by lowering of the bottom lid.

* * * * *